US011566403B2

(12) United States Patent
Clarke et al.

(10) Patent No.: US 11,566,403 B2
(45) Date of Patent: Jan. 31, 2023

(54) FAUCET

(71) Applicant: Kohler Co., Kohler, WI (US)

(72) Inventors: Gary N. Clarke, Sheboygan, WI (US); Rodney L. Weekley, Mequon, WI (US); Jacob R. Frye, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 407 days.

(21) Appl. No.: 16/214,331

(22) Filed: Dec. 10, 2018

(65) Prior Publication Data

US 2019/0106866 A1 Apr. 11, 2019

Related U.S. Application Data

(63) Continuation of application No. 15/611,414, filed on Jun. 1, 2017, now Pat. No. 10,233,618.

(60) Provisional application No. 62/345,372, filed on Jun. 3, 2016.

(51) Int. Cl.
*E03C 1/04* (2006.01)

(52) U.S. Cl.
CPC .... *E03C 1/0404* (2013.01); *E03C 2001/0414* (2013.01)

(58) Field of Classification Search
CPC ..... E03C 1/0405; E03C 2001/0414; E03C 2001/0415; E03C 1/06; E03C 1/0404; F16M 11/10; F16M 11/2064; F16M 11/2014; F16M 11/2092; F16M 11/24; F16M 11/2021; F16M 13/00–022; Y10T 137/8807
USPC ..... 239/587.3; 4/567, 568, 654, 638; 137/801
See application file for complete search history.

(56) References Cited

U.S. PATENT DOCUMENTS 2,103,410 A * 12/1937 Frei, Jr. ..... E01F 9/627 52/113
2,492,049 A * 12/1949 Krone ..... B61K 11/02 137/615
2,727,534 A * 12/1955 Briede ..... F16L 27/0861 137/615
2,739,778 A * 3/1956 Krone ..... F16L 27/0861 403/111

(Continued)

FOREIGN PATENT DOCUMENTS

CN 1888501 A 1/2007
CN 202215815 U 5/2012

(Continued)

*Primary Examiner* — Tuongminh N Pham
*Assistant Examiner* — Juan C Barrera
(74) *Attorney, Agent, or Firm* — Patterson Thuente, P.A.

(57) ABSTRACT

A faucet that includes a base; a collar extending from the base, wherein the collar is rotatable relative to the base about a longitudinal axis; a control arm comprising a first end movably coupled to the collar and a second end opposite the first end; a sprayhead configured to emit water; a magnetic spheroidal joint comprising a ball and a socket, wherein at least one of the ball and the socket is magnetic and attracts the other of the ball and the socket through a magnetic force, one of the ball and the socket is coupled to the sprayhead, and the other of the ball and the socket is coupled to the second end of the control arm; and a flexible hose separate from the control arm and configured to fluidly connect the sprayhead and the base.

15 Claims, 17 Drawing Sheets

(56) References Cited

U.S. PATENT DOCUMENTS

| | | | | |
|---|---|---|---|---|
| 4,709,715 | A * | 12/1987 | Knight | B08B 3/006 134/177 |
| 5,185,893 | A * | 2/1993 | Lin | E03C 1/023 137/597 |
| 6,450,425 | B1 * | 9/2002 | Chen | E03C 1/06 239/587.4 |
| 8,869,821 | B2 | 10/2014 | Laera | |
| 2008/0196160 | A1 * | 8/2008 | Alder | F16L 11/16 4/678 |
| 2012/0267497 | A1 * | 10/2012 | Bowman | F16M 11/2014 248/280.11 |
| 2013/0019974 | A1 * | 1/2013 | Laera | E03C 1/0404 137/801 |
| 2013/0221184 | A1 * | 8/2013 | Odaka | F16M 11/10 248/560 |
| 2013/0320116 | A1 * | 12/2013 | Jonte | B05B 15/62 239/600 |
| 2015/0308088 | A1 * | 10/2015 | Enlow | E03C 1/0404 137/1 |
| 2018/0112820 | A1 * | 4/2018 | Lau | F16M 11/14 |

FOREIGN PATENT DOCUMENTS

| | | | |
|---|---|---|---|
| CN | 204114282 | U | 1/2015 |
| CN | 204647419 | U | 9/2015 |

* cited by examiner

FAUCET

CROSS-REFERENCE TO RELATED APPLICATIONS

This application is a Continuation of U.S. patent application Ser. No. 15/611,414, filed Jun. 1, 2017, which claims the benefit of U.S. Provisional Patent Application No. 62/345,372, filed Jun. 3, 2016. All of the aforementioned U.S. patent applications are hereby incorporated by reference herein in their entireties.

BACKGROUND

The present application relates generally to the field of faucets for dispensing water. More specifically, this application relates to faucets having control arms interconnecting movable sprayheads to bases of the spout.

SUMMARY

At least one embodiment of the present application relates to a faucet that includes a base, a sprayhead, a flexible hose, and a control arm. The base is mountable to a mounting surface. The sprayhead is movable relative to the base and is configured to emit water in at least one spray pattern. The flexible hose is separate from and outside of the control arm, and the flexible hose connects the sprayhead and the base. The control arm includes a first end and a second end, wherein the first end is pivotally connected to the base to allow rotation of the control arm relative to the base, and wherein the second end is detachably coupled to the sprayhead such that in a docked position, movement of the control arm moves the sprayhead relative to the base, and such that in a detached position, the sprayhead is movable relative to the base and the control arm.

One of the second end of the control arm and the sprayhead may include a magnet that applies a magnetic force to attract the other of the second end and the sprayhead to couple the second end and the sprayhead together in the docked position.

One of the second end of the control arm and the sprayhead may include a ball and the other of the second end and the sprayhead may include a socket, wherein the socket receives the ball in the docked position to detachably couple the sprayhead and the control arm together. For example, the second end of the control arm may include the socket, the sprayhead may include the ball, one of the ball and the socket may include the magnet and the other of the ball and the socket may include a ferromagnetic material. For example, the second end of the control arm may include the ball and the sprayhead may include the socket.

The faucet may include a collar. The collar may be disposed on an end of the base, such as an end that is opposite a mounting end of the base. The collar may be rotatable relative to the base about a longitudinal axis of the base. A first end of the control arm may be coupled to the collar. For example, the first end of the control arm may be pivotally coupled to the base through the collar such that the control arm rotates relative to the collar and the base about a pivot axis that is transverse to the longitudinal axis.

The faucet may include a retainer that is configured to maintain a position (e.g., a rotational position) of the control arm relative to the base, such as following movement (e.g., rotation) of the control arm relative to the base. By way of non-limiting example, the retainer may include at least one of a spring, a detent, or a ratchet. For example, the retainer may include a bushing assembly and a tension member. The bushing assembly may be configured to rotatably connect the control arm to the collar. The bushing assembly may include a shaft having an inner shoulder and an outer shoulder, where the inner shoulder is coupled to the collar through an aperture thereof, and the outer shoulder is coupled to the control arm through an aperture thereof. The tension member may be disposed at least in part within the control arm. The tension member may include a first end and a second end, where the first end is coupled to the control arm, and the second end is coupled to the shaft such that the tension member can rotate freely relative to the shaft during rotation of the control arm relative to the collar.

The control arm may be configured to include a first arm portion, which has the first end of the control arm, and a second arm portion, which has the second end of the control arm. The first and second arm portions may be telescopically adjustable relative to one another. For example, at least one of the first and second arm portions may include a hollow section such that the other of the first and second arm portions slides within the hollow section during telescopic adjustment.

At least one embodiment of the present application relates to a faucet that includes a base, a sprayhead, a flexible hose, and a control arm. The base may be configured to mount to a mounting surface. The sprayhead is movable relative to the base and is configured to emit water in at least one spray pattern. The flexible hose is separate from and outside of the control arm, and the flexible hose connects the sprayhead and the base. The control arm includes a first arm and a second arm. The first arm has a first end that is pivotally connected to the base to allow rotation of the first arm relative to the base. The second arm has a first end coupled to the sprayhead, and a second end of the first arm and a second end of the second arm are telescopically connected together to adjust a length of the control arm.

The first end of the second arm may be coupled to the sprayhead through a ball joint. The ball joint may include a ball and a socket, such as where the second arm includes one of the ball and the socket, and the sprayhead includes the other of the ball and the socket. For example, the sprayhead may include an outer housing and a socket, and the socket may include a hollow cylindrical projection extending from a side of the outer housing, where the projection receives the ball of the first end of the second arm.

The faucet may include a collar disposed on an end of the base that is opposite a mounting end of the base. The collar may be rotatable relative to the base about a longitudinal axis. The first end of the first arm may be pivotally connected to the base through the collar such that the first arm is rotatable relative to the collar about a pivot axis that is transverse to the longitudinal axis.

The first end of the second arm may be configured to detachably couple to the sprayhead through a magnet and a ferromagnet, such that in a docked position, movement of the second arm moves the sprayhead relative to the base, and such that in a detached position, the sprayhead is movable relative to the base and the control arm.

At least one embodiment of the present application relates a faucet that includes a base, a collar, a sprayhead, a control arm, and a flexible hose. The base is configured to mount to a mounting surface. The collar is rotatably coupled to the base such that the collar is rotatable about a rotational axis relative to the base. The sprayhead is movable relative to the base and the collar, where the sprayhead is configured to emit water in at least one spray pattern. The control arm is coupled to the collar through a first spheroidal joint to allow free rotation of the control arm relative to the collar, and the control arm is coupled to the sprayhead through a second spheroidal joint to allow free rotation of the sprayhead relative to the control arm. The flexible hose connects an inlet of the sprayhead and an outlet of the collar. The flexible hose is also separate from and outside of the control arm.

Each of the first and second spheroidal joints may, for example, include a ball and a socket. The control arm may include the ball of the first spheroidal joint that is coupled to one end of the control arm and may also include the ball of the second spheroidal joint that is coupled to an opposite end of the control arm. The collar may include an outer wall and the socket of the first spheroidal joint, which includes a first hollow cylindrical projection extending from the outer wall. The sprayhead may include an outer housing and the socket of the second spheroidal joint, which includes a second hollow cylindrical projection extending from the outer housing.

The control arm may include a first arm and a second arm. The first arm may include a first end that is coupled to the first spheroidal joint; and the second arm may include a first end that is coupled to the second spheroidal joint. A second end of the first arm and a second end of the second arm may be telescopically connected together to adjust a length of the control arm. One of the first and second arms may include a bore that receives at least a portion of the other of the first and second arms in a shortened position.

DETAILED DESCRIPTION

Figure 2:
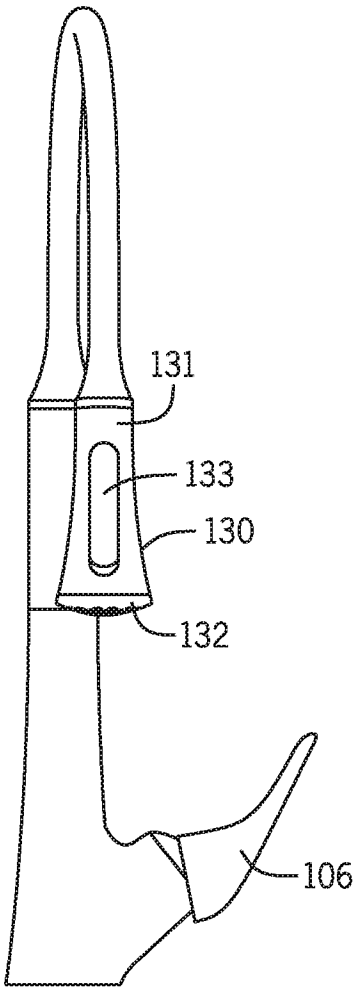
FIG. 2 is a front view of the faucet shown in FIG. 1.

Referring generally to the Figures, disclosed herein are various embodiments of faucets that include control arms that provide for added control over movement of a sprayhead relative to a base of the spout. The control arms are configured to interconnect (e.g., detachably, fixedly, etc.) movable sprayheads to the bases to support forces/loads from the sprayheads while providing an increased range of coverage of the sprayhead. The control arms may be adjustable (e.g., telescopically) or may have a fixed length. The control arms may be configured to swing, to pivot, or to provide other movements. The control arms may include joints (e.g., ball joints) to provide additional movement and control.

FIGS. 1-8 illustrate an exemplary embodiment of a faucet 101 having a pivoting control arm. The faucet 101 includes a base 102 (e.g., spout base), a sprayhead 103, a flexible hose 104 connecting (e.g., physically, fluidly) the sprayhead 103 and the base 102, and a control arm 105. As discussed in more detail below, the control arm 105 may advantageously help control the movement of the sprayhead 103 when coupled (e.g., docked, attached, etc.) to the control arm 105, support the forces (e.g., weight) from the sprayhead 103, as well as provide other advantages.

The base 102 is configured to be fixedly mounted (e.g., secured, attached, etc.) to a mounting surface, such as a sink, countertop or other suitable surface. The base 102 is hollow such that other elements of the faucet 101 can be routed or housed within the base 102. For example, the base 102 may house a valve, one or more water delivery lines (e.g., conduits, etc.) for carrying water, or other elements of the faucet.

The faucet 101 includes a valve for controlling flow of water therethrough. For example, the faucet 101 may include a mixing valve that controls a flow of hot water, cold water, or a mixture of hot and cold waters through the base 102 and the hose 104 to the sprayhead 103. According to another example, the valve may control the flow of water from a single source through the faucet 101. Any type of valve may be employed with the faucets of this application. The valve may be located anywhere in the faucet 101 (e.g., within the base 102) or external to the faucet 101 (e.g., below the base 102) and fluidly connected thereto.

Figure 1:
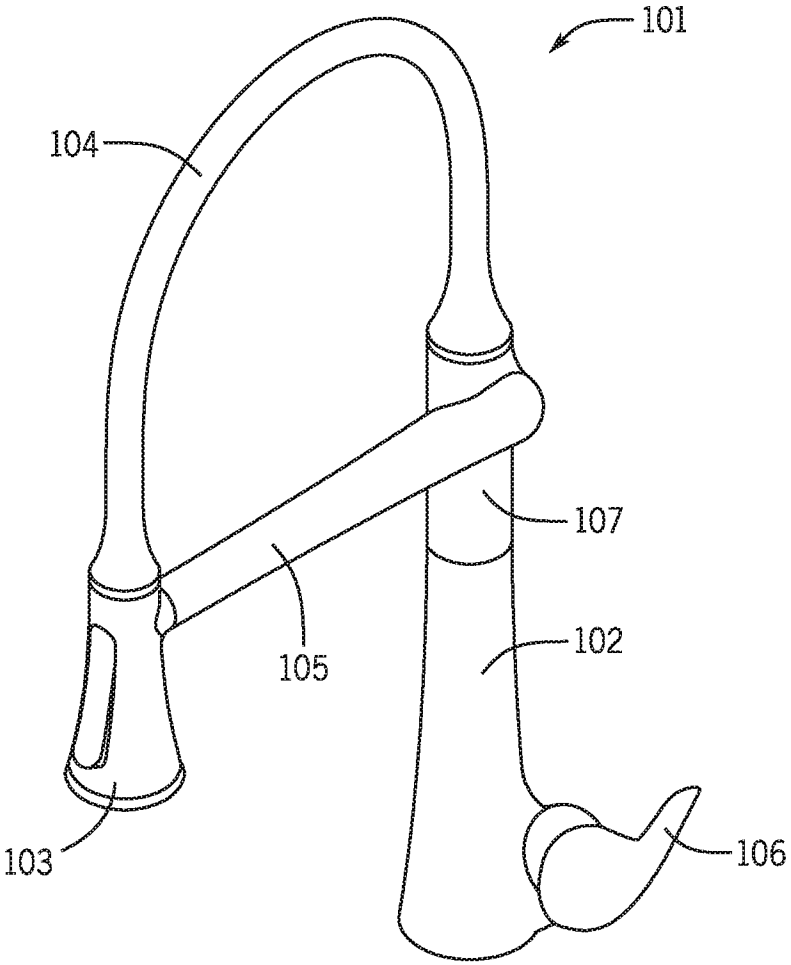
FIG. 1 is a perspective view of an exemplary embodiment of a faucet having a pivoting control arm.
Figure 4:
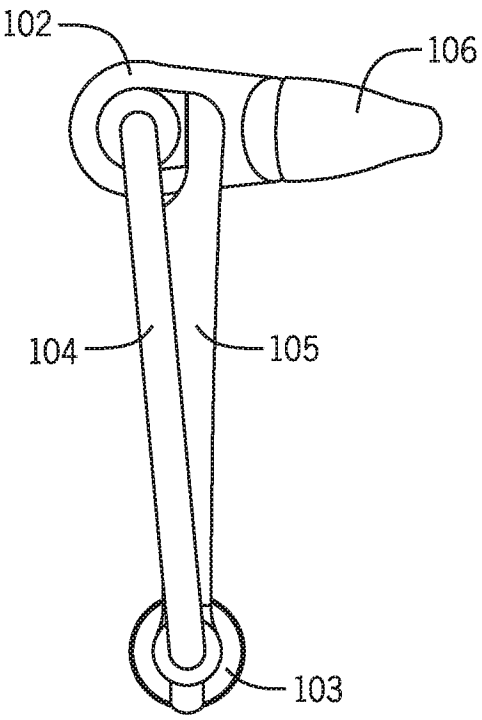
FIG. 4 is a top view of the faucet shown in FIG. 1.

The faucet 101 may include a handle for controlling operation of a valve. As shown in FIG. 1, the handle 106 is moveably mounted to the base 102 to control operation of the faucet, such as by controlling operation of a valve. The handle 106 can be moved relative to the base 102 to adjust, for example, the flow rate and/or the temperature of water emitted from the sprayhead 103 of the faucet 101. The handle 106 can have any suitable configuration (e.g., shape, location, etc.). According to other examples, the faucet may include more than one handle or no handles at all, such as if the faucet includes sensing technology to control operation of the faucet.

The sprayhead 103 is configured to be moveable relative to the base 102 of the faucet and to emit water in one or more spray patterns. The sprayhead 103 can be configured according to any suitable configuration. By way of non-limiting examples, the sprayhead 103 can be configured similar to (e.g., having the same or similar structure and configuration, except where noted otherwise) the sprayheads disclosed in U.S. patent application Ser. No. 14/547,913 (filed on Nov. 19, 2014); U.S. patent application Ser. No. 14/207,244 (filed on Mar. 12, 2014); and/or U.S. patent application Ser. No. 13/359,089 (filed on Jan. 26, 2012), which are incorporated by reference herein in their entireties. It is noted that other sprayheads can be employed with the faucets of this application and the sprayheads disclosed in the above identified applications are intended as examples.

Figure 3:
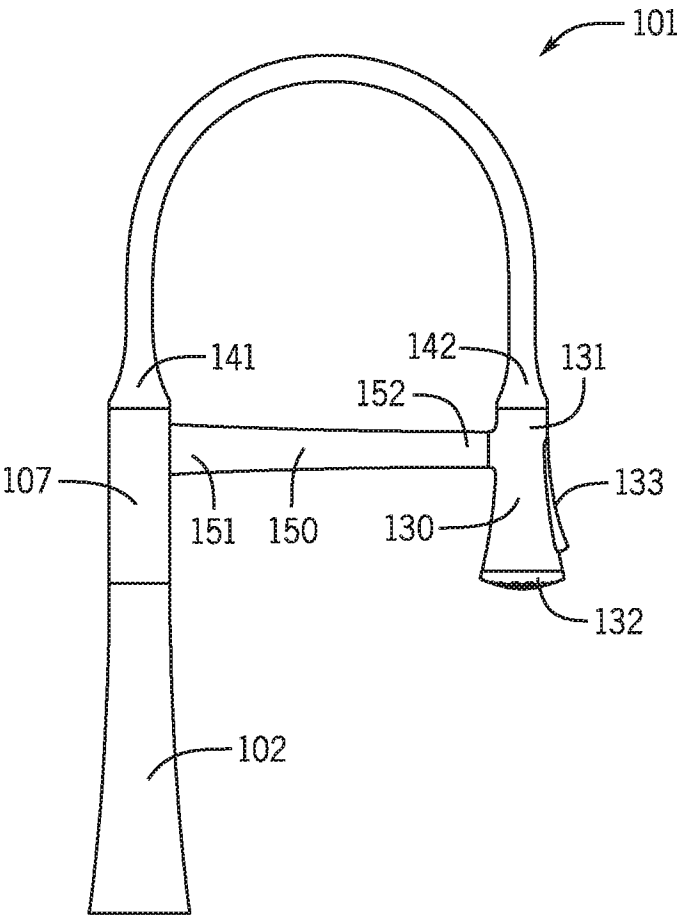
FIG. 3 is a side view of the faucet shown in FIG. 1.
Figure 6:
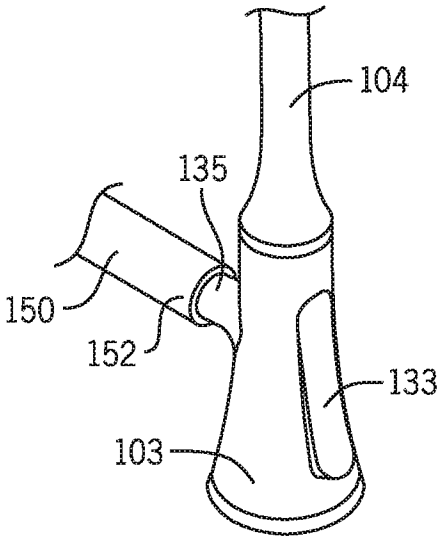
FIG. 6 is a detail view of a portion of the faucet shown in FIG. 1.

As shown in FIGS. 2 and 3, the sprayhead 103 includes a body 130 extending between an inlet end 131 and an outlet end 132. The inlet end 131 is connected to the flexible hose 104 and the outlet end 132 includes a sprayface containing a nozzle or a plurality of nozzles. The sprayhead 103 includes one or more actuators for controlling operation of the sprayhead 103. As shown, the sprayhead 103 includes an actuator 133 that is configured to control operation of the sprayhead 103. According to one example, the actuator 133 is a soft touch spray button including silicone over (e.g., overmolded onto) a flexible substrate. As discussed in more detail below, the sprayhead 103 also includes a docking feature for coupling to (and decoupling from) the control arm 105.

The flexible hose 104 is configured to physically and fluidly connect the base 102 and the sprayhead 103. The hose 104 is flexible to allow the sprayhead 103 to be moved (e.g., articulated, etc.) relative to the fixed base 102, such as to redirect the spray from the sprayhead 103. According to one non-limiting example, the hose 104 includes a sheathing surrounding a fluid conduit. The fluid conduit is configured to allow fluid (e.g., water) to flow therethrough, such as to fluidly connect the base 102 and the sprayhead 103. The sheathing is configured to protect the fluid conduit to prevent or reduce the likelihood of damage to the conduit. The sheathing includes a first material (e.g., silicone), which according to one example is overmolded onto the fluid conduit, which includes a second material (e.g., polymer) that is pliable. According to one example, the hose is pliable enough to support its own weight, without causing the sprayhead 103 to move when repositioned.

The hose 104 includes a first end 141 and a second end 142. As shown in FIG. 3, the first end 141 is coupled to the base 102 (either directly or indirectly through an intervening member, such as an element of the control arm, the collar, etc.) and the second end 142 is coupled to the sprayhead 103 (either directly or indirectly through an intervening member).

The control arm 105 is configured to support the sprayhead 103 by transferring loads back to base 102 while allowing for movement of the sprayhead 103 relative to the base 102. As shown in FIGS. 1-8, the control arm 105 includes an arm 150 having a first end 151 and a second end 152.

Figure 8:
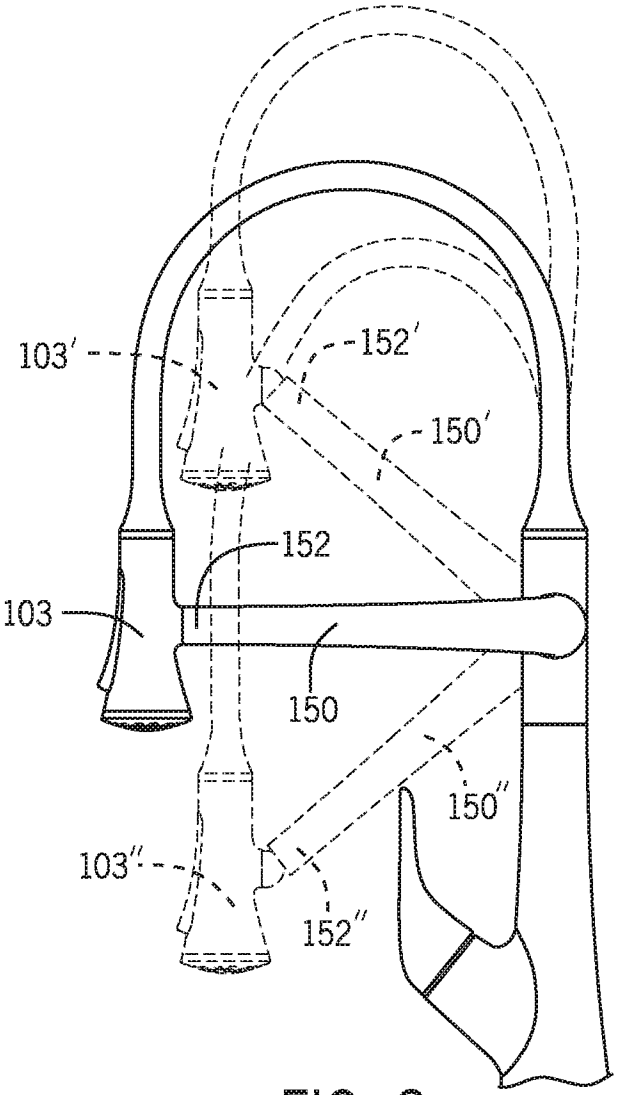
FIG. 8 is a side view of the faucet shown in FIG. 1 showing a general range of movement of the sprayhead and control arm with the sprayhead and control coupled together.

The first end 151 of the arm 150 is pivotally connected to a collar 107 (see FIGS. 3 and 5), which can be part of the base 102 or part of the control arm 105 of the faucet 101, through a pivot mechanism such that the arm 150 can rotate (e.g., pivot) relative to the base 102 and the collar 107, such as in a generally vertically extending plane. For example, the arm 150 may include a stud (e.g., post) that pivotally engages a bearing in the collar 107. Alternatively, the collar 107 may include a stud that engages a bearing in the arm 150. This arrangement advantageously allows for the arm 150 to support loads from the sprayhead 103 when the sprayhead 103 is in different positions. Illustrating this point, FIG. 8 shows the arm 150 in various positions (e.g., a first horizontal position of the arm 150, a second elevated position of the arm 150', and a third lowered position of the arm 150") and supporting the sprayhead 103, 103', 103" docked to the second end 152, 152', 152" of the respective arm.

The collar 107 may be fixed relative to the base 102. For example, the collar 107 may be integrally formed with the base 102. As shown in FIGS. 1-8, the collar 107 is configured to rotate relative to the base 102 about a longitudinal axis 120 (e.g., a substantially vertical axis) of the base and/or collar. This arrangement allows the arm 105 to swing relative to the base 102 with the rotating collar 107. For example, when the control arm 105 is in the horizontal position, the control arm 105 rotates with the collar 107 in a generally horizontal plane. The base 102 may be configured to rotationally support the collar 107.

Figure 5:
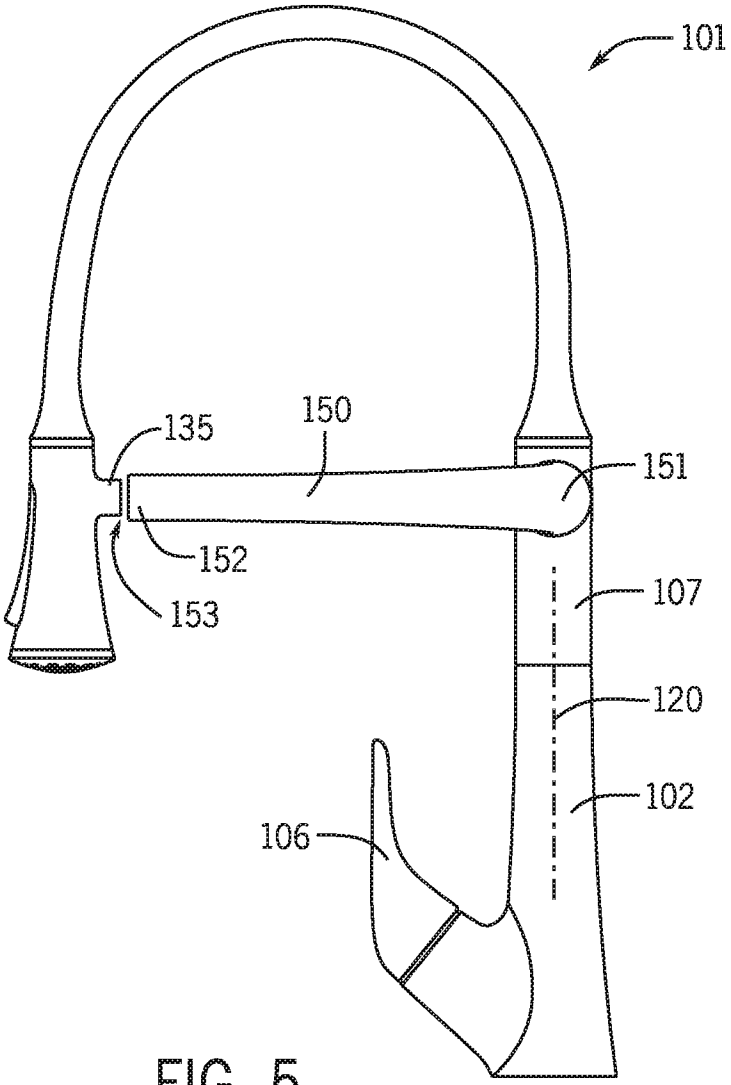
FIG. 5 is another side view of the faucet shown in FIG. 1 with the sprayhead detached from the control arm.
Figure 7:
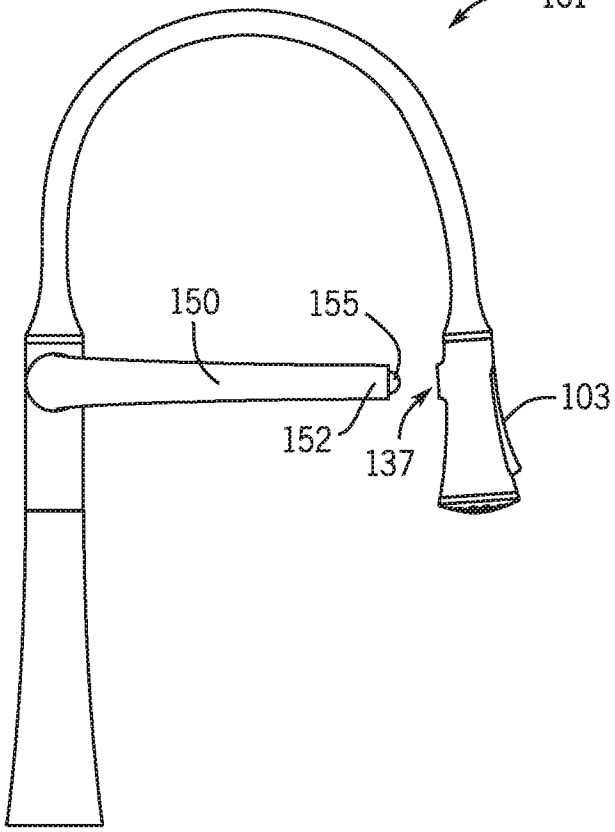
FIG. 7 is yet another side view of the faucet shown in FIG. 1 with the sprayhead detached from the control arm.

The second end 152 of the control arm 105 is configured to be coupled to the sprayhead 103 to support loads therefrom. As shown, the second end 152 is configured to detachably couple to the sprayhead 103 to support the sprayhead 103 when docked together and to further allow the sprayhead 103 to be moved independently of the control arm 150 when the sprayhead 103 is detached from the second end 152. This arrangement provides additional utility, such as allowing a greater reach by the sprayhead 103. By way of example, FIGS. 5 and 7 show the sprayhead 103 detached from the arm 150.

The faucet 101 may include a docking feature to allow the sprayhead 103 to be docked to and detached from the arm 150. According to one exemplary embodiment, the docking feature includes a ball and a socket that detachably receives the ball. As shown in FIG. 5, the second end 152 of the arm 150 includes a socket (e.g., cup, concave recess, etc.) and the sprayhead 103 includes a ball 135 (e.g., a generally or partially spherical element) that is configured to engage the socket in the second end 152. As shown in FIG. 7, the second end 152 of the arm 150 includes a ball, and the sprayhead 103 includes a socket that receives the ball.

The docking feature may be magnetized (e.g., employ a magnet) to apply a force (e.g., magnetic force) to retain the ball and socket when coupled together. For example, one of the ball and the socket may include a magnet or be magnetic and the other of the ball and the socket may include a ferromagnetic portion or be ferromagnetic, such that a magnetic force attracts the ball and socket to one another. The magnetic force can be tailored to the application, such as, for example, the magnetic force can be stronger for faucets having relatively higher weight sprayheads and/or hoses, whereas the magnetic force can be weaker for faucets having relatively lower weight sprayheads and/or hoses. The detachable docking feature (e.g., utilizing a magnetic socket and ball) advantageously allows for a user to move (e.g., rotate) the sprayhead independently from the arm.

The arm (e.g., the arm 150) having a joint may be configured to stay in place when moved to a new position, such as by overcoming the weight of the sprayhead and the hose. A feature, such as a detent, as spring, or other suitable element, may be employed to bring and/or retain the arm in a "home" position (e.g., level with horizontal), while allowing the arm to be raised and lowered when only a moderate force is applied to the arm. Thus, the joint may be configured to resist moving when set in a position, rather than springing back to a set position (e.g., the "home" position, the previous position, etc.).

According to other examples, the control arms of the faucets may have other configurations. By way of example, the control arms may be configured as pivoting control arms that are fixedly connected to the sprayheads, as pivoting arms that are extendible, as double jointed arms, as swing style arms, or as other suitable arms.

Figure 10:
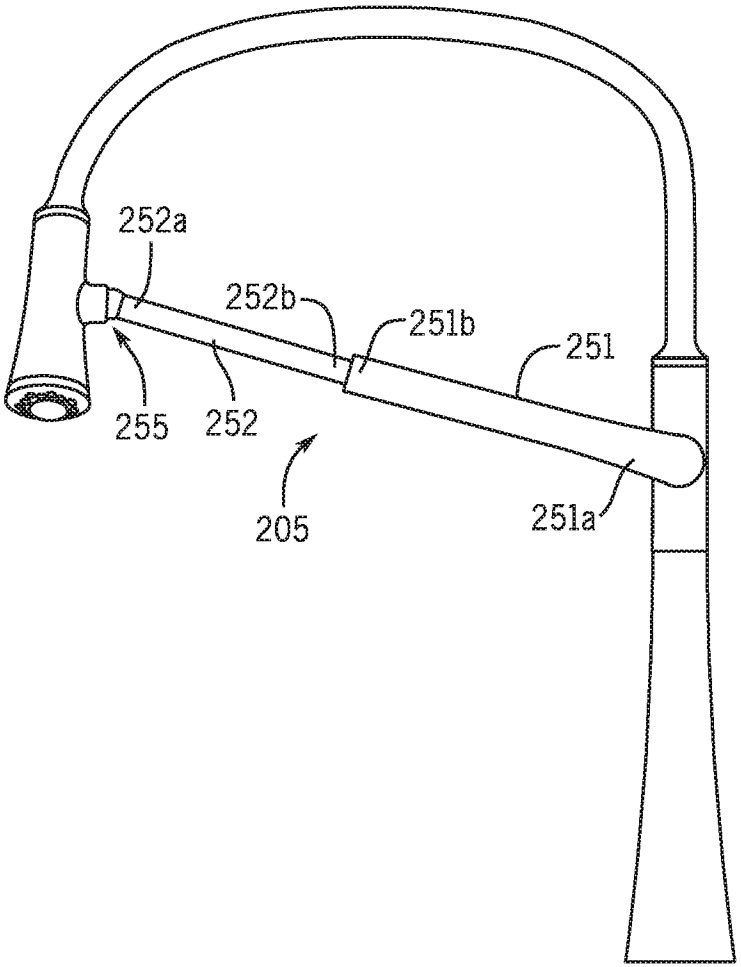
FIG. 10 is a side view of the faucet shown in FIG. 9 with the control arm in an extended position.
Figure 9:
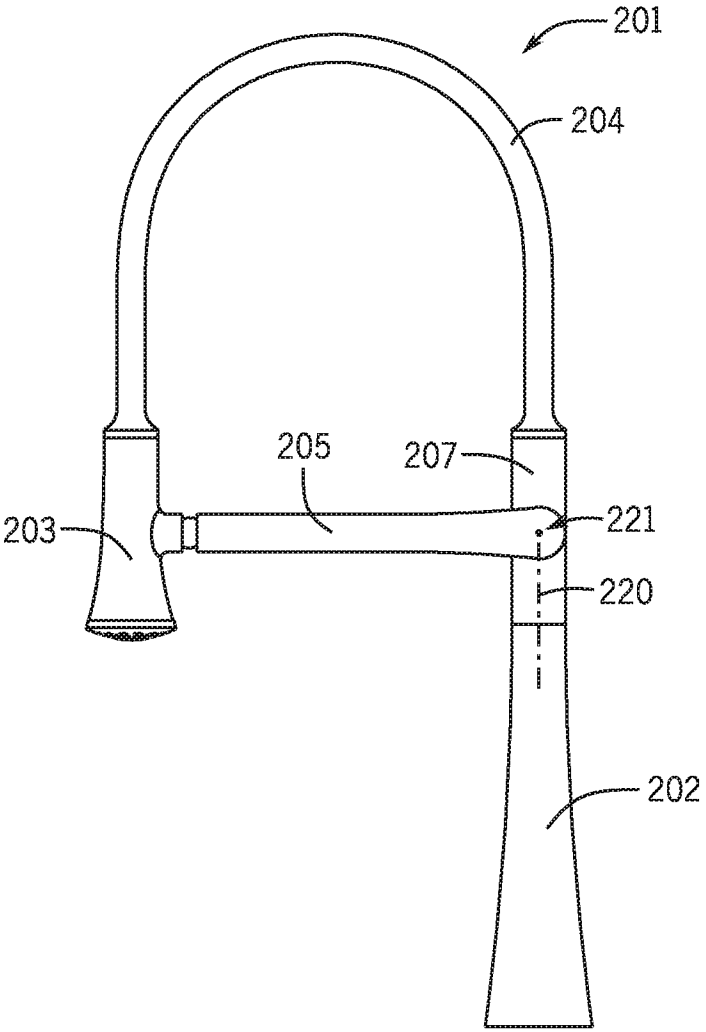
FIG. 9 is a side view of another exemplary embodiment of a faucet having a pivoting control arm.
Figure 11:
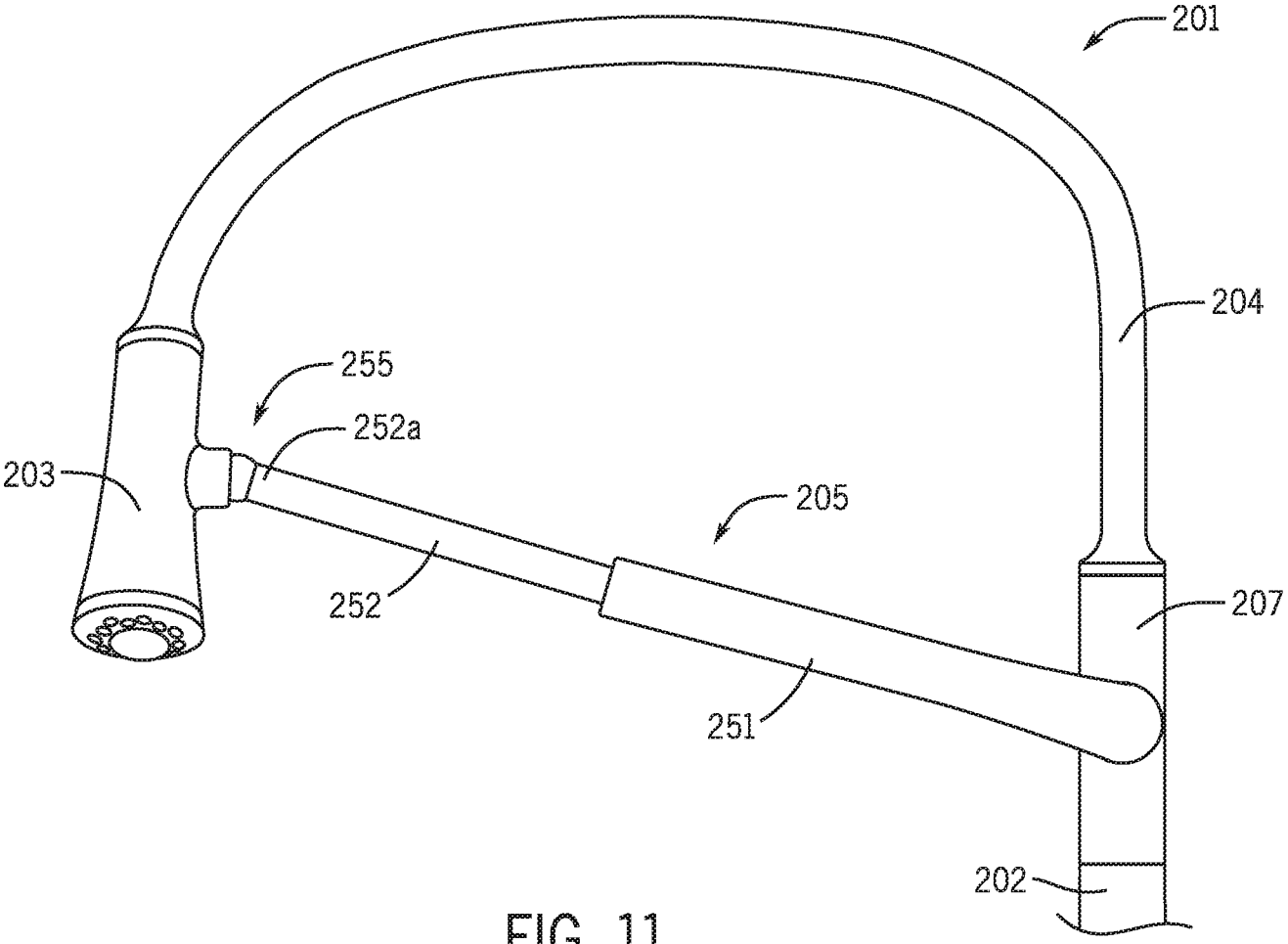
FIG. 11 is a detail view of a portion of the faucet shown in FIG. 10.

FIGS. 9-11 illustrate another exemplary embodiment of a faucet 201 having a pivoting control arm 205 that is extendible in length. The faucet 201 includes a base 202 that is configured the same as the base 102 (e.g., having a rotating collar 207 to allow rotation of the control arm 205 and collar 207 relative to the base 202), a hose 204 that is configured the same as the hose 104, and a sprayhead 203 that is configured the same as the sprayhead 103, except where noted otherwise.

The control arm 205 includes a plurality of arms that are moveable relative to one another to allow for the length of the control arm 205 to be increased (e.g., in an extended position) or decreased (e.g., in a retracted position). As shown best in FIGS. 10 and 11, the control arm 205 of the faucet 201 includes a first arm 251 and a second arm 252 that are configured to move telescopically relative to one another. However, it is noted that the faucets disclosed herein may be configured having a telescopic control arm having more than two arms, such as to provide for a broader range of motion of the control arm.

The first arm 251 of the control arm 205 has a first end 251*a* that is pivotally coupled to the collar 207 (to allow the control arm 205 to be rotated in a plane of rotation that is substantially orthogonal to the plane of rotation of the collar 207) and a second end 251*b* that is telescopically connected to the second arm 252. For example, a first end of the control arm 205 (e.g., a first end of the first arm 251) may be pivotally coupled to the base 202 through the collar 207, such that the control arm 205 rotates relative to the collar 207 and the base 202 about a pivot axis 221 that is transverse (e.g., orthogonal) to a longitudinal axis 220. As shown, the first arm 251 is a hollow member such that the second arm 252 (or at least a portion thereof) can be moved into and out of a bore in the first arm 251 to provide the telescoping movement. Alternatively, the second arm 252 may be configured having a bore that receives at least a portion of the first arm 251 to provide the telescoping movement.

The second arm 252 of the control arm 205 has a first end 252*a* coupled to the sprayhead 203 and a second end 252*b* that is telescopically connected to the first arm 251. As shown, the first end of the second arm 252 is coupled to the sprayhead 203 with a spheroidal joint, such as a ball joint 255 that includes a ball and a socket. As shown best in FIG. 11, the ball is part of the first end 252*a* of the second arm 252 and the socket is part of the sprayhead 203. For example, the sprayhead may include an outer housing and the socket, and the socket may include a hollow cylindrical projection extending from a side of the outer housing. Accordingly, the projection receives the ball of the first end of the second arm. However, according to another example, the ball is part of the sprayhead 203 and the socket is part of the second arm 252. The ball joint 255 can be magnetized to allow for the sprayhead 203 to be detached from the control arm 205, or the ball joint 255 can be configured not to detach the ball and the socket to rotatably secure the control arm to the sprayhead. Thus, the control arm 205 may be configured to be permanently or detachably connected to the sprayhead 203, such as through the ball joint 255.

As shown, the first and second arms 251, 252 can be telescopically adjusted to shorten or lengthen the distance between the first end 252*a* of the second arm 252 and the first end 251*a* of the first arm 251, which in turn increases or decreases the distance between the sprayhead 203 and the base 202. The force necessary to adjust the first and second arms 251, 252 telescopically can be tailored to specific applications.

Figure 13:
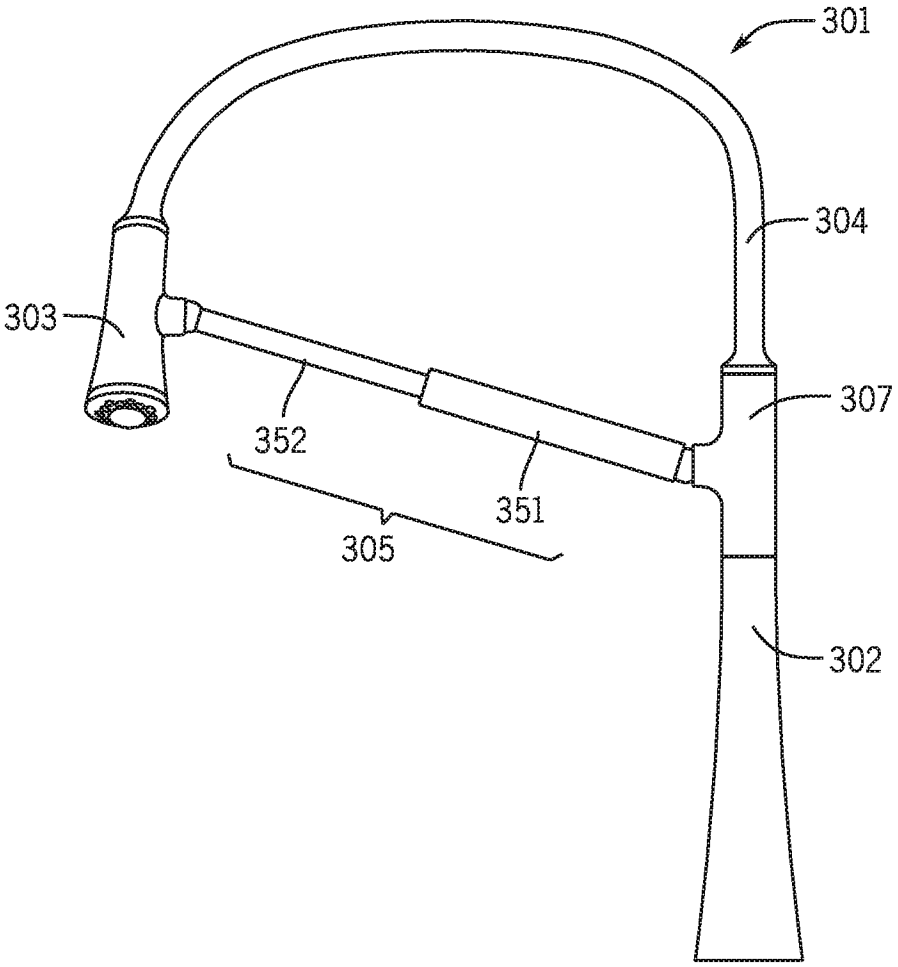
FIG. 13 is another side view of the faucet shown in FIG. 12 with the control arm in an extended position.
Figure 12:
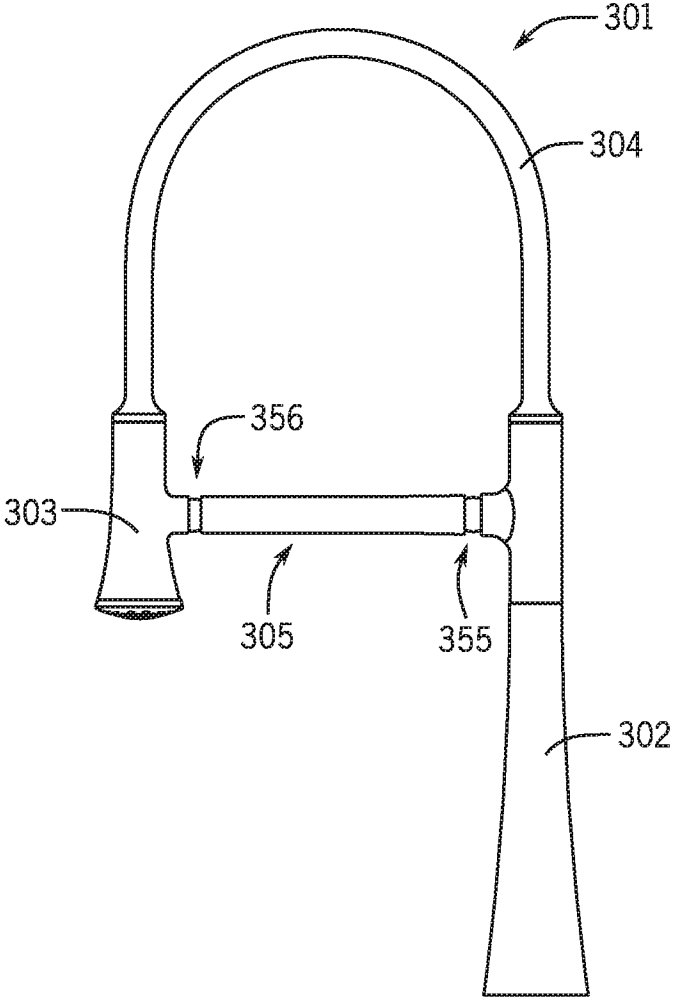
FIG. 12 is a side view of an exemplary embodiment of a faucet having a double jointed control arm.
Figure 14:
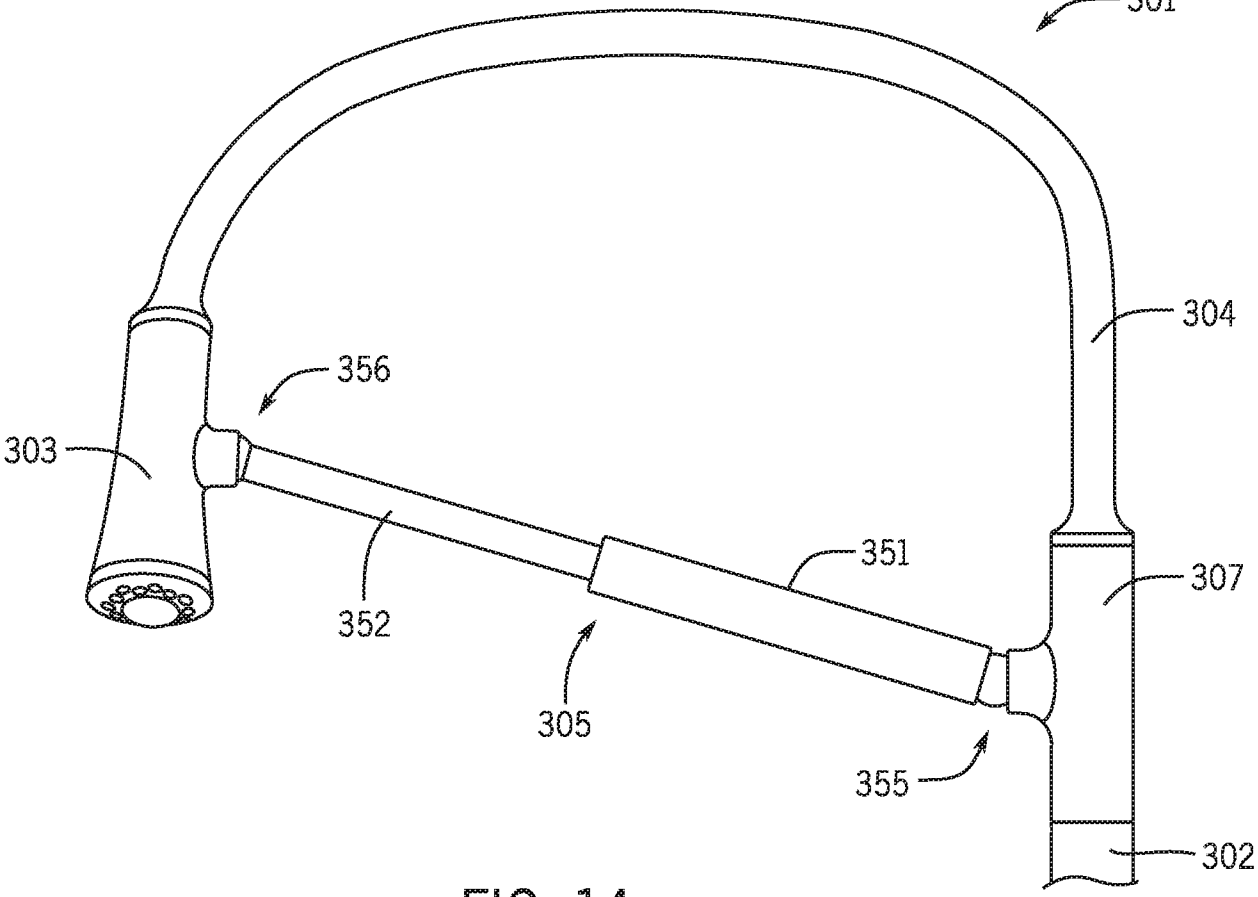
FIG. 14 is a detail view of a portion of the faucet shown in FIG. 13.

FIGS. 12-14 illustrate another exemplary embodiment of a faucet 301 having a double jointed adjustable control arm. The faucet 301 includes a base 302 that is configured the same as the base 102 (e.g., having a rotating collar to allow rotation of the control arm 305 and collar relative to the base 302), a flexible hose 304 that is configured the same as the hose 104, and a sprayhead 303 that is configured the same as the sprayhead 103, except where noted otherwise.

The control arm 305 includes two or more arms that are moveable relative to one another to allow for the length of the control arm 305 to be increased or decreased by extending or retracting the arms. As shown best in FIGS. 13 and 14, the control arm 305 of the faucet 301 includes a first arm 351 and a second arm 352 that are configured to move telescopically relative to one another. As shown, the first and second arms 351, 352 move in a linear direction along a longitudinal axis of the arms. However, it is noted that the faucets disclosed herein may be configured having a telescopic control arm having two or more arms that are curved or have another suitable shape and still provide the relative motion to extend/retract the control arm.

The first arm 351 of the control arm 305 has a first end that is coupled to the collar 307 with a first ball joint 355 (e.g., primary ball joint) to allow the control arm 305 to be rotated relative to the collar 307. The ball joint 355 includes a ball and a socket, with one of the ball and the socket being coupled to the first end of the first arm 351 and the other of the ball and the socket being coupled to the collar 307. The ball and socket of the first ball joint 355 may be permanently coupled together or may be separable, such as by using a magnetized ball joint.

The first arm 351 also includes a second end that is telescopically connected to the second arm 352. As shown, the first arm 351 is a hollow member such that the second arm 352 (or at least a portion thereof) can be inserted into and withdrawn from a bore in the first arm 251 to provide the telescoping movement. Alternatively, the second arm 352 may be configured having a bore that receives at least a portion of the first arm 351 to provide the telescoping movement.

The second arm 352 of the control arm 305 has a first end coupled to the sprayhead 303 and a second end that is telescopically connected to the first arm 351. As shown, the first end of the second arm 352 is coupled to the sprayhead 303 with a second ball joint 356 that includes a ball and a socket. As shown best in FIG. 14, the ball is part of the first end of the second arm 352 and the socket is part of the sprayhead 303. However, the ball may be configured as part of the sprayhead 303 and the socket may be configured as part of the second arm 352. The second ball joint 356 can be magnetized to allow for the sprayhead to be detached from the control arm, or the ball and socket of the second ball joint 356 can be configured permanently coupled. Thus, the control arm 305 may be configured to be permanently or detachably connected to the sprayhead 303.

As shown and described, the first and second arms 351, 352 of the control arm 305 can be telescopically adjusted to shorten or lengthen the distance between the first end of the second arm 352 and the first end of the first arm 351 to in turn increase or decrease the distance between the sprayhead 303 and the base 302. The force necessary to adjust the first and second arms 351, 352 telescopically can be tailored to specific applications.

The control arm 305 (as well as any other adjustable control arm disclosed in this application) may be configured with a locking feature that can selectively lock the first and second arms 351, 352 in a position (e.g., an extended position, a retracted position, etc.). The locking feature may lock the arms of the control arm 305 in a set number of positions or may lock the arms in any relative arrangement.

FIGS. 15-20 illustrate another exemplary embodiment of a faucet 401 having a swing style control arm. The faucet 401 includes a base 402 that is configured the same as the base 102, a flexible hose 404 that is configured the same as the hose 104, and a sprayhead 403 that is configured the same as the sprayhead 103, except where noted otherwise.

Figure 16:
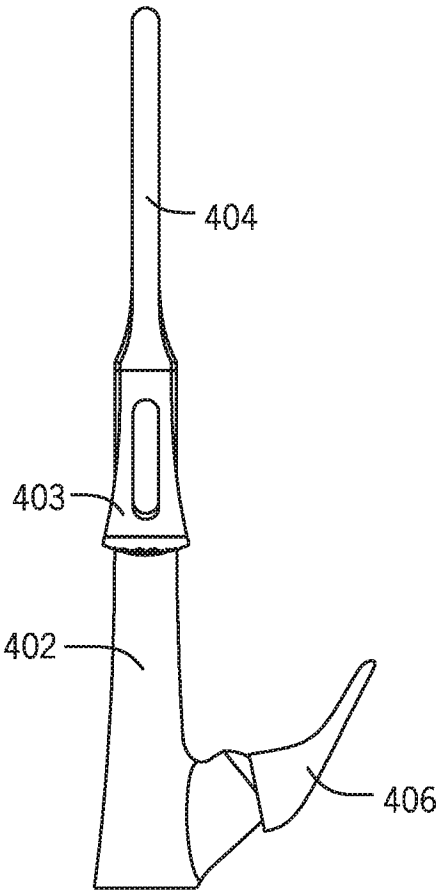
FIG. 16 is a front view of the faucet shown in FIG. 15.
Figure 15:
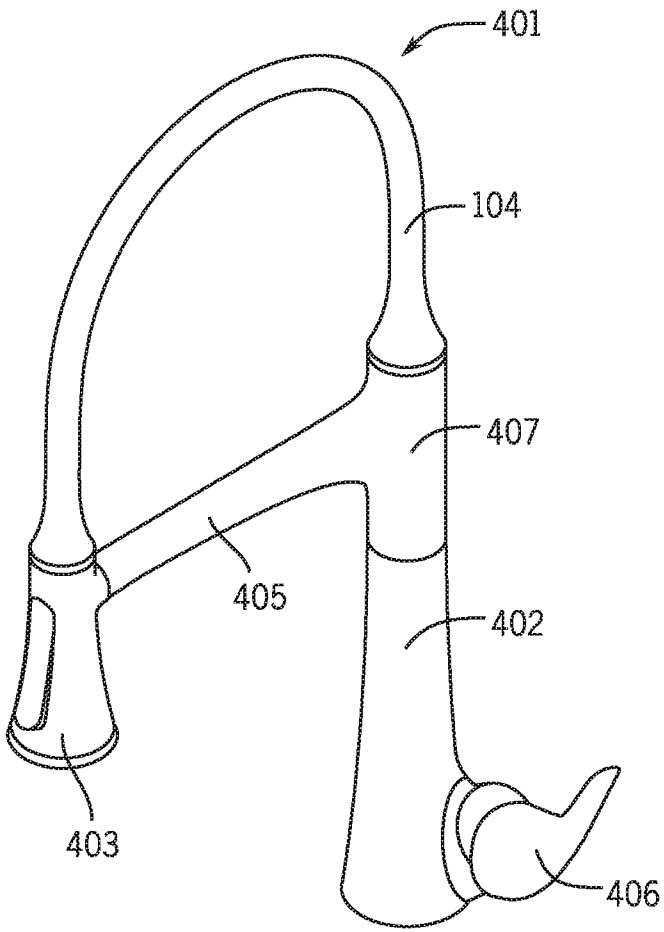
FIG. 15 is a perspective view of an exemplary embodiment of a faucet having a swing style control arm.
Figure 18:
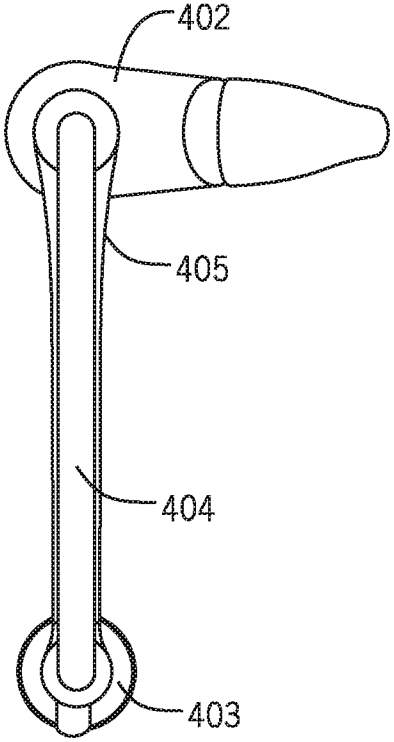
FIG. 18 is a top view of the faucet shown in FIG. 15.

The faucet 401 may include a handle for controlling an operation of faucet 401. As shown in FIGS. 15 and 16, a single handle 406 is moveably mounted to the base 402 to control operation of the faucet, such as by controlling operation of a valve that supplies the sprayhead 403 with water. The handle 406 can be moved relative to the base 402 to adjust the flow rate and/or the temperature of water emitted from the sprayhead 403 of the faucet 401. It is noted that the faucet 401 may include more than one handle or no handles at all, such as if the faucet includes sensing (e.g., touchless) technology to control operation of the faucet.

As shown in FIGS. 15-20, the collar 407 and the control arm 405 are integrally formed as a unitary (e.g., single, non-separable) element. According to other examples, the control arm 405 and the collar 407 are formed separately then coupled together such that they operate/function together as one element (e.g., are fixedly coupled together).

The collar 407 of the faucet 401 is rotatably coupled to an end (shown as the top end) of the base 402. For example, the collar 407 may be configured as a sleeve (e.g., a generally cylindrical element) that fits over a supporting element (e.g., a support sleeve, a bearing, etc.) of the base 402 to support rotation of the collar 407 relative to the base 402.

Figure 17:
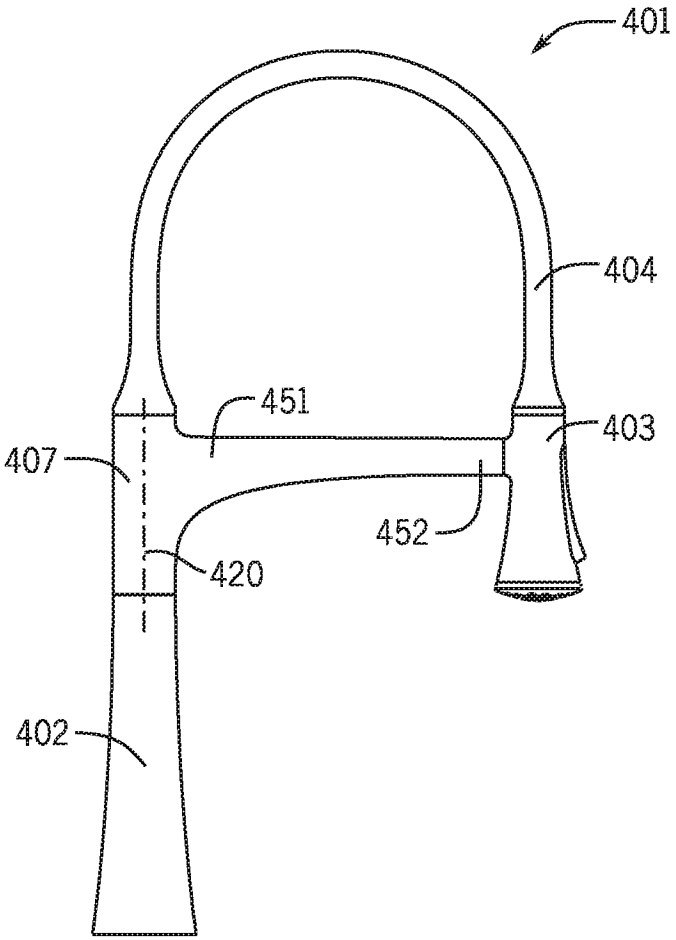
FIG. 17 is a side view of the faucet shown in FIG. 15.
Figure 20:
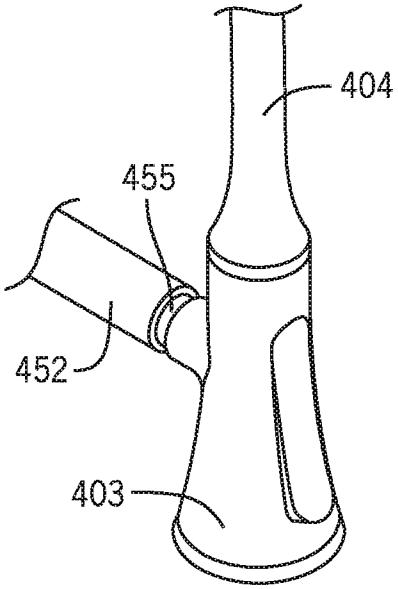
FIG. 20 is a detail view of a portion of the faucet shown in FIG. 15.

The control arm 405 of the faucet 401 is fixed relative to the collar 407 such that rotation of the collar 407 rotates the control arm 405 by the same amount (e.g., the same angular rotation about a longitudinal axis 420 of the collar 407, as shown in FIG. 17). As shown, a first end 451 of the control arm 405 is fixedly connected to (e.g., integrally formed with) the collar 407. A second end 452 of the control arm 405, which is opposite the first end, is configured to couple to the sprayhead 403 to support the sprayhead 403.

Figure 19:
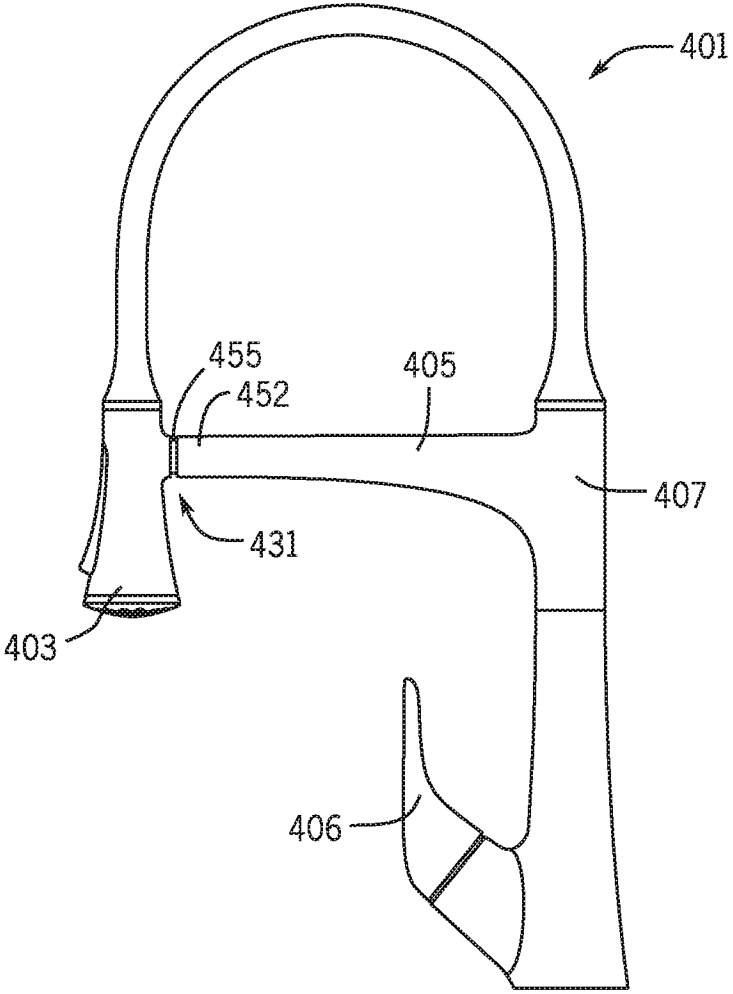
FIG. 19 is another side view of the faucet shown in FIG. 15 with the sprayhead detached from the control arm.

As shown best in FIG. 19, the second end 452 of the control arm 405 includes a magnet that is configured to attract (e.g., through a magnetic force) the sprayhead 403 to detachably couple the control arm 405 and the sprayhead 403 through magnetism. The magnet may be an element 455 (e.g., cylindrical element, puck shaped element) disposed in the second end 452, which may be configured to extend beyond the second end 452 such as to engage a recess 431 in the sprayhead 403 when securing the sprayhead 403 and control arm 405 together. At least a portion (e.g., an extension, a wall, a body, etc.) defining the recess 431 includes a ferromagnetic material that is attracted to the magnet.

According to another example, the sprayhead 403 includes the magnet and the control arm 405 includes a ferromagnetic connecting feature/element, such as a recess to receive the magnet. It is noted that the magnet and ferromagnetic connecting features may have other configurations and that the examples described herein are not limiting, but are exemplary.

The arrangement of the faucet 401 allows a user of the faucet to move the sprayhead 403 relative to the base 402 in a swinging motion along a circular arc about a rotational axis of the collar 407 (shown in FIG. 17 as the longitudinal axis) when the sprayhead 403 is connected (e.g., docked) to the control arm 405. When docked, the control arm supports the sprayhead 403 distributing forces (e.g., from its weight) back to the base 402 to make it relatively easy to move and/or maintain the use position of the sprayhead 403. Also when docked, the sprayhead 403 can be rotated relative to the second end 452 (e.g., in a plane defined by a surface of the second end or the magnet coupled thereto) to align the sprayhead 403 at any angle relative to vertical to provide additional coverage by the spray pattern of the sprayhead 403.

The arrangement of the faucet 401 also allows a user of the faucet to detach the sprayhead 403 from the control arm 405 such that the sprayhead 403 can reach objects outside of the radius of the arc of the control arm 405. When detached, the sprayhead 403 can be moved anywhere within a range defined by the flexible hose 404.

Figure 22:
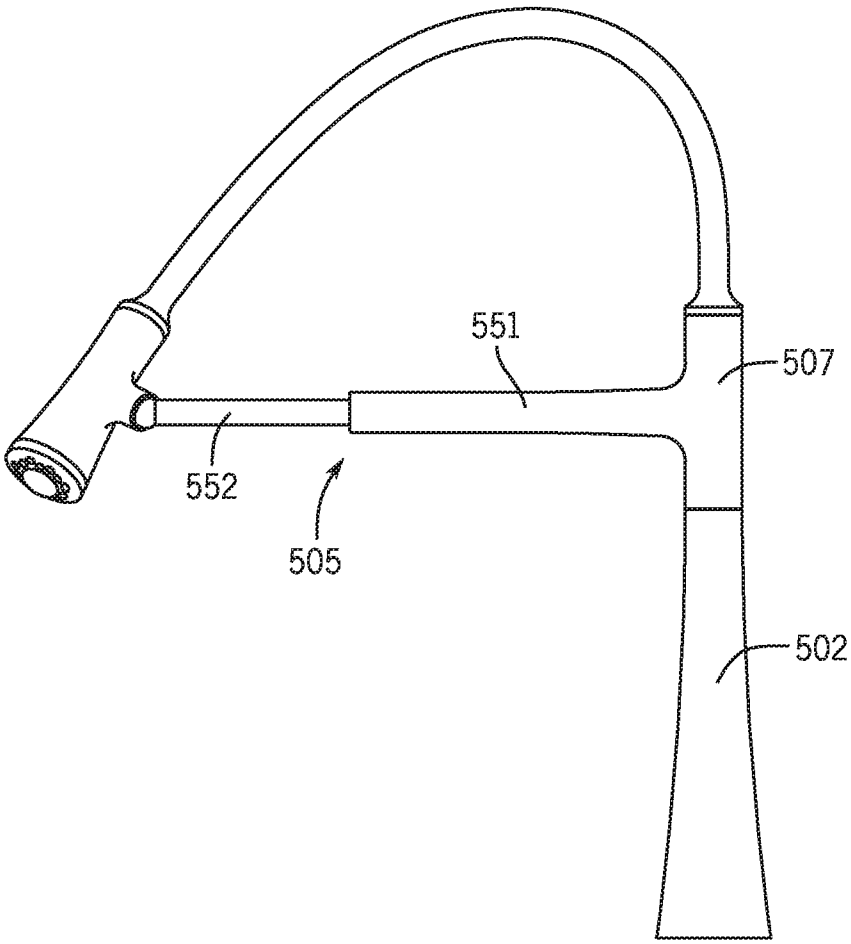
FIG. 22 is another side view of the faucet shown in FIG. 21 with the control arm in an extended position.
Figure 21:
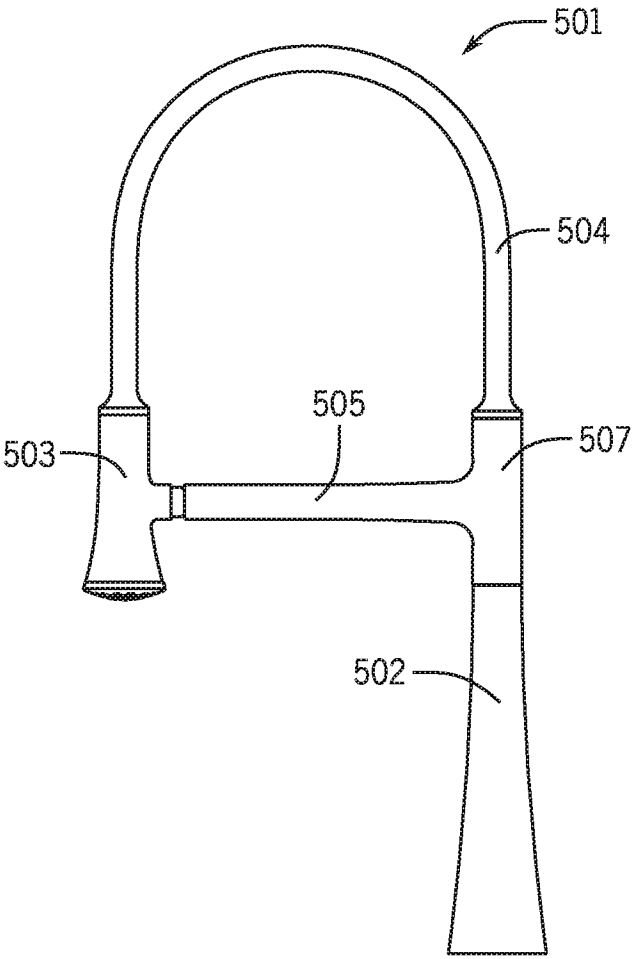
FIG. 21 is a side view of another exemplary embodiment of a faucet having a swing style control arm.
Figure 23:
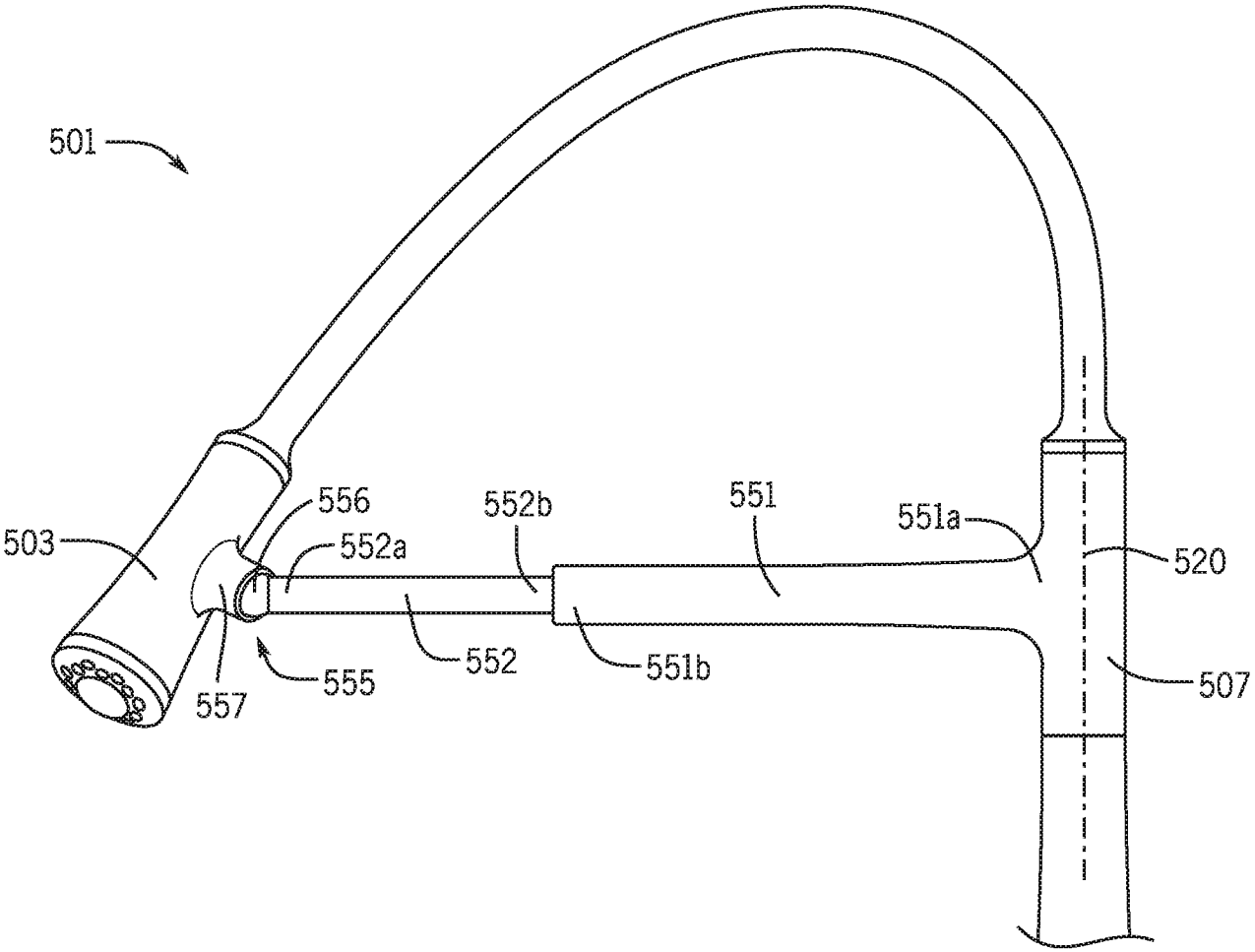
FIG. 23 is a detail view of a portion of the faucet shown in FIG. 22.
Figure 24:
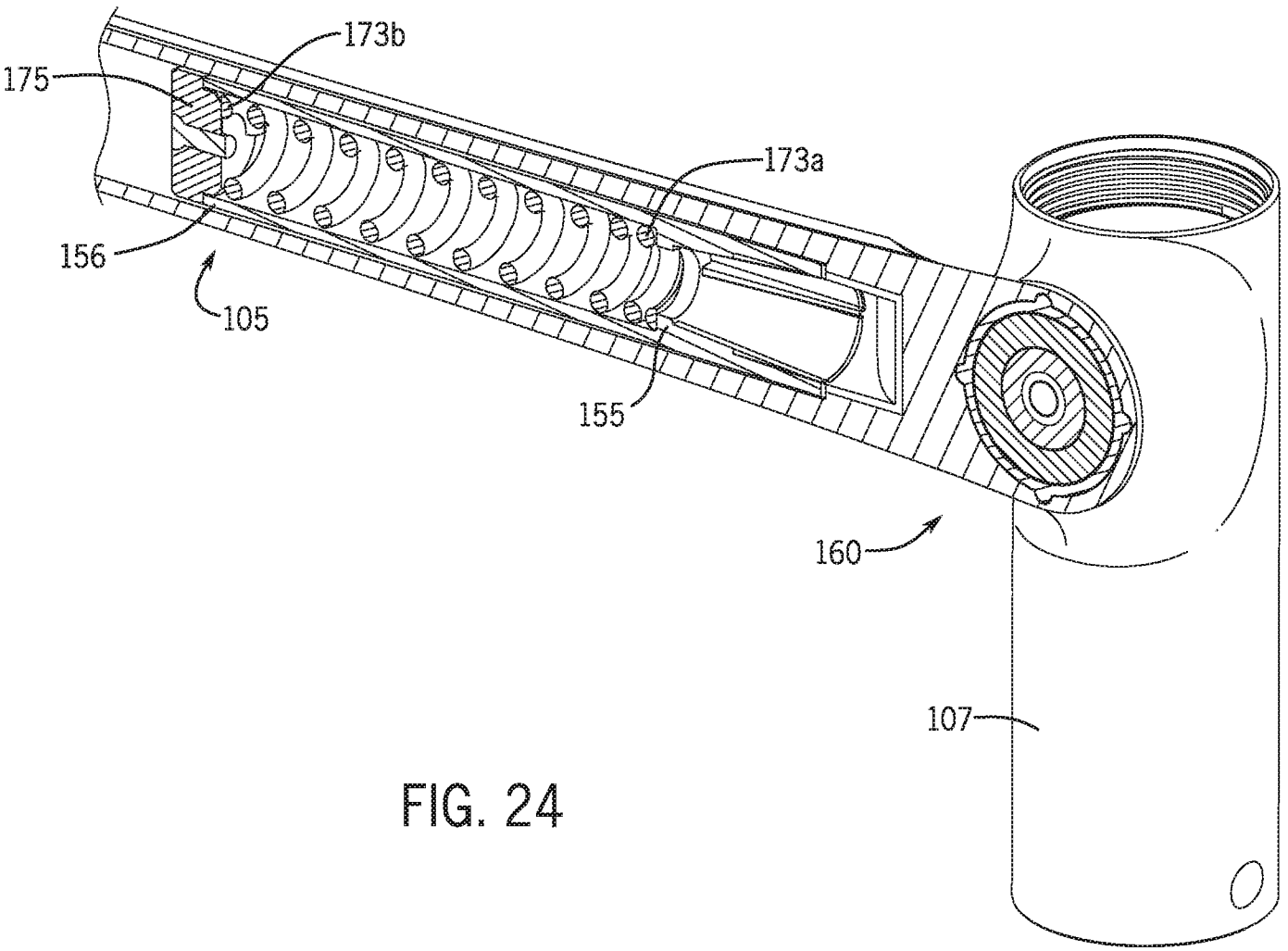
FIG. 24 is a perspective partial cutaway view of a control arm including a retainer and pivot assembly rotatably coupled to a collar.

FIGS. 21-23 illustrate yet another exemplary embodiment of a faucet 501 having a swing style control arm 505 that extends/retracts to provide an increased range of coverage by a sprayhead 503 when docked to the control arm 505. The faucet 501 also includes a collar 507 rotatably supported on a base 502 and a flexible hose 504 connecting the sprayhead 503 and the collar 507. The base 502 is configured the same as the base 402, the hose 504 is configured the same as the hose 104, and the sprayhead 503 is configured the same as the sprayhead 103, except where noted otherwise.

Like with the faucet 401, the collar 507 and the control arm 505 of the faucet 501 operate as one element. The collar 507 and the control arm 505 may be integrally formed as a unitary (e.g., single, non-separable) element, or formed separately then coupled together such that they operate/function together as one element. The collar 507 is configured the same as the collar 407, except where noted otherwise.

The control arm 505 includes two or more arms that are moveable relative to one another to allow for the length of the control arm 505 to be increased and decreased (e.g., to extend and retract the control arm 505). As shown best in FIGS. 22 and 33, the control arm 505 of the faucet 501 includes a first arm 551 and a second arm 552 that are configured to move (e.g., telescopically) relative to one another to expand/retract the control arm 505 (FIG. 21 shows a retracted position and FIGS. 22 and 23 show an extended position). As shown best in FIG. 23, a first end 551*a* of the first arm 551 is fixed relative to the collar 507 such that rotation of the collar 507 rotates the first arm 551 by the same amount (e.g., the same angular rotation about a longitudinal axis 520 of the collar 507 and/or the base 502). The first end 551*a* of the first arm 551 is fixedly connected to (e.g., integrally formed with) the collar 507. A second end 551*b* of the first arm 551, which is opposite the first end 551*a*, is adjustably coupled to the second arm 552. As shown, the first arm 551 is a hollow member such that the second arm 552 (or at least a portion thereof) can be moved into and out of a bore in the first arm 551 to provide the telescoping movement. Alternatively, the second arm 552 may be configured having a bore that receives at least a portion of the first arm 551 to provide the telescoping movement.

A first end 552*a* of the second arm 552 of the control arm 505 is coupled to the sprayhead 503 and a second end 552*b* of the second arm 552 is telescopically connected to the first arm 551. As shown, the first end 552*a* of the second arm 552 is coupled to the sprayhead 503 with a ball joint 555. The ball joint 555 includes a ball 556 and a socket 557 that receives the ball 556 and allows for relative movement (e.g., free rotation about the spherical ball) between the ball 556 and the socket 557. The ball 556 is part of the first end 552*a* of the second arm 552 or the sprayhead 503, and the socket 557 is part of the other of the sprayhead 503 and the first end 552*a* of the second arm 552. The ball joint 555 can be magnetized to allow for the sprayhead to be detached from the second arm 552, or the ball 556 and the socket 557 may be permanently connected together.

Thus, the first and second arms 551, 552 can be adjusted (e.g., telescopically) to shorten or lengthen the distance between the first end 552*a* of the second arm 552 and the first end 551*a* of the first arm 551, which in turn increases or decreases the distance between the sprayhead 503 and the base 502. The ball joint 555 also allows for free rotation of the sprayhead 503 relative to the control arm 505 (e.g., the first end 552*a* of the second arm 552) to further increase the range of coverage of the sprayhead 503.

FIGS. 24-28 illustrate an exemplary embodiment of a control arm 105 that is rotatably coupled to a collar 107 through a retainer and pivot assembly 160. The retainer and pivot assembly 160 is configured to facilitate rotation of the control arm 105 relative to the collar 107 and further is configured to retain the control arm 105 in the rotational position of the control arm 105 relative to the collar 107. By way of example, the retainer and pivot assembly 160 can retain the control arm in the positions shown by 150, 150' and 150" in FIG. 8, as well as any other position of the control arm 150 in the range of motion of the control arm 150 (e.g., a circular motion along a radius of rotation).

As shown, the retainer and pivot assembly 160 includes a bushing assembly 161 and a tension assembly 163 coupled to the bushing assembly 161 and the control arm 150. The bushing assembly 161 facilitates rotation of the control arm 105 relative to the collar 107, and the tension assembly 163 maintains the rotational position of the control arm 105 relative to the collar 107 by maintaining a threshold friction, as discussed below in more detail.

Figure 25:
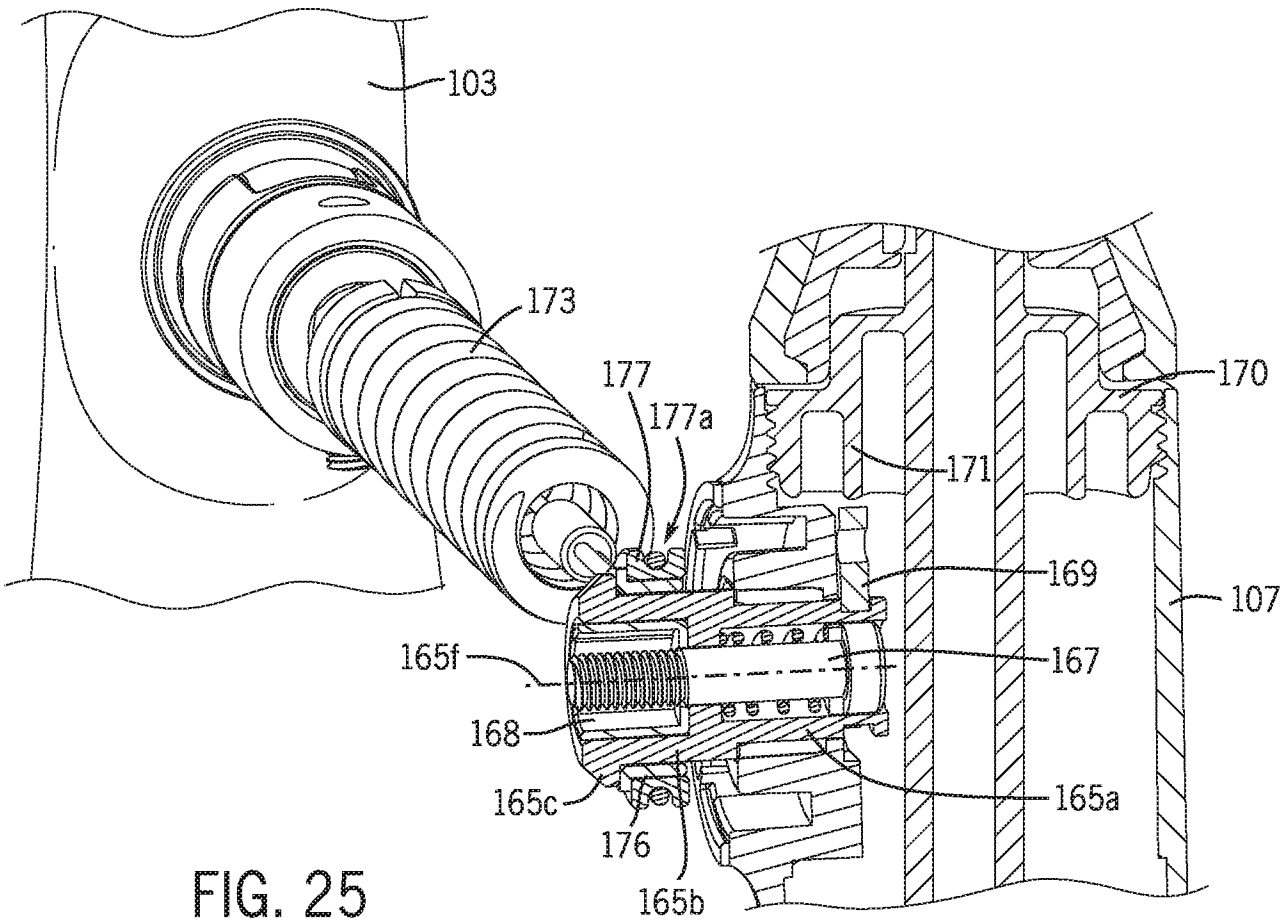
FIG. 25 is another perspective partial cutaway view of the control arm, retainer and pivot assembly, and collar shown in FIG. 24.
Figure 27:
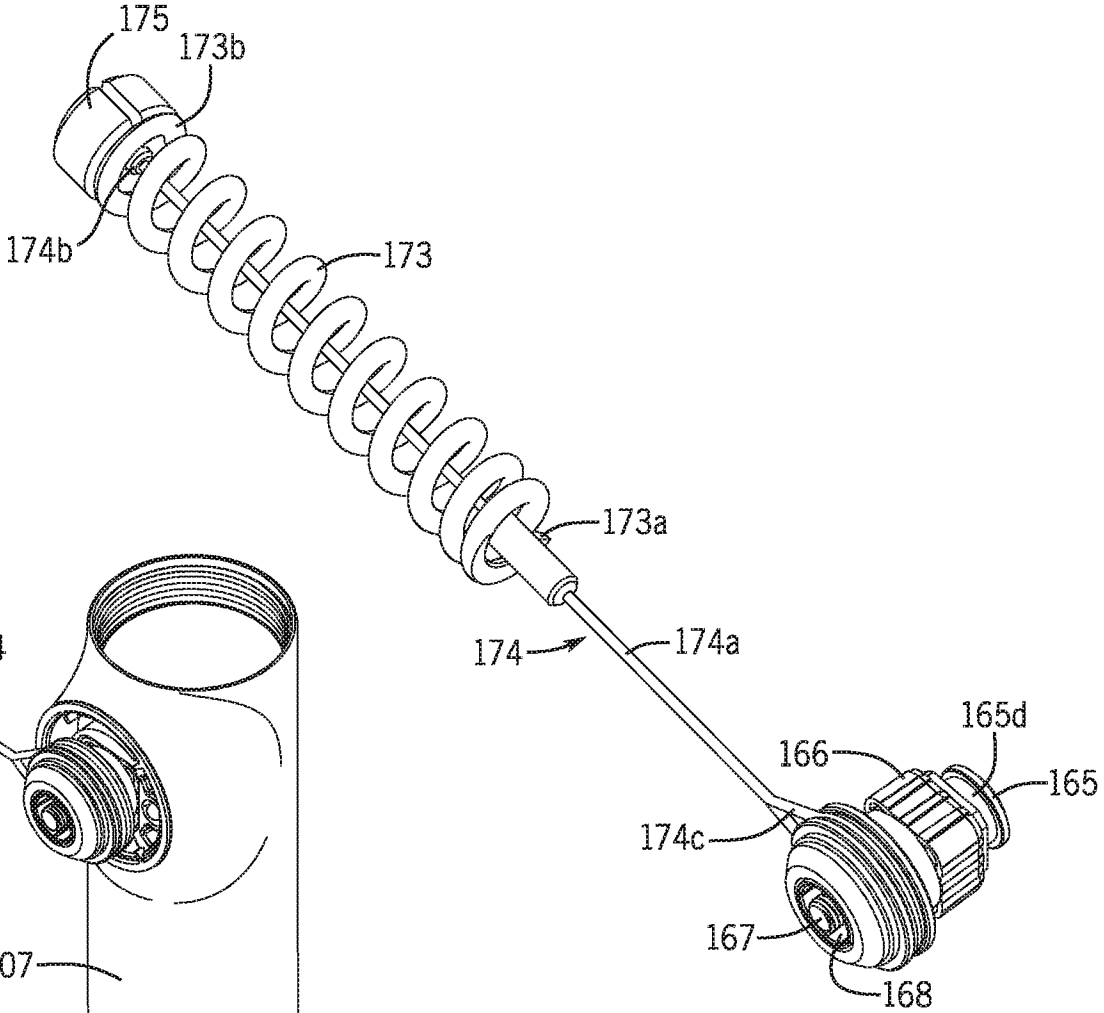
FIG. 27 is a perspective view of the retainer and pivot assembly shown in FIG. 24.
Figure 26:
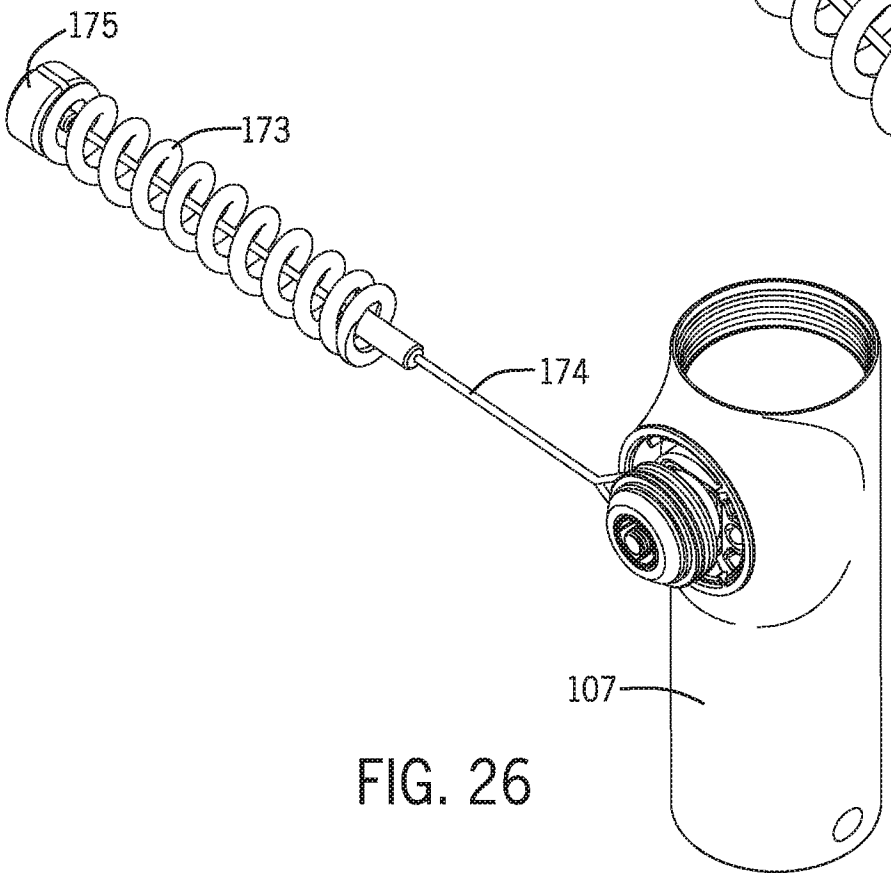
FIG. 26 is a perspective view of the collar and the retainer and pivot assembly shown in FIG. 24 with the control arm removed for clarity.

The bushing assembly 161 includes a shaft 165 having a first shoulder 165*a* (e.g., inner shoulder) that engages the collar 107, as shown in FIGS. 25 and 26. The first shoulder 165*a* may be configured to prevent relative rotation between the shaft 165 and one of the control arm 105 and the collar 107. As shown, the first shoulder 165*a* is square shaped and is received in a complementary hole in the collar 107 to prevent relative rotation between the shaft 165 and the collar 107. As shown in FIG. 27, a bearing 166 is disposed around at least a portion of the first shoulder 165*a* to seat between a wall of the collar 107 and the first shoulder 165*a*. The bearing 166 has a shape (e.g., square, splined, polygonal, etc.) that provides anti-rotation between the bearing 166, the shaft 165 and the collar 107.

The shaft 165 also includes a second shoulder 165*b* (e.g., outer shoulder) that receives and supports part of the tension assembly 163. For example, the second shoulder 165*b* may support a bearing and/or a split ring, as discussed below in more detail. Disposed on the second shoulder 165*b* is a flange 165*c* for retaining the bearing and/or split ring onto the second shoulder 165*b*.

The bushing assembly 161 may include a fastener 167 that is configured to couple the control arm 105 to the bushing assembly 161. As shown in FIG. 25, the fastener 167 extends through a bore in the shaft 165, such that threads of the fastener 167 thread to threads of the control arm 105. The shaft 165 may include a radial inwardly extending inner shoulder that is configured to support the fastener 167.

The bushing assembly 161 may include a second bearing 168 that is configured to support rotation of the control arm 105 relative to the shaft 165. As shown in FIG. 25, the second bearing 168 is disposed in a bore in the second shoulder 165*b* of the shaft 165. By way of example, the control arm 105 may include a post that includes the threads that thread to the fastener 167, where the post may engage the second bearing 168 (e.g., a bore therein).

The bushing assembly 161 may be coupled to the collar 107 using a locking plate 169 that engages a channel 165*d* (e.g., an undercut/recessed section relative to the adjacent sections) in the first shoulder 165*a* of the shaft 165 (see FIGS. 25 and 27). The locking plate 169 includes an opening that is shaped to complement the shape of the channel to prevent the shaft 165 from moving along a longitudinal axis 165*f* of the shaft 165. The locking plate 169 is retained in the collar 107, as shown in FIG. 25, to retain the bushing assembly 161 (and control arm 105, which is not shown in FIG. 25 for clarity) to the collar 107. A cap 170 may be employed to retain the locking plate 169 in a direction transverse to the longitudinal axis 165*f*. As shown in FIG. 25, the cap 170 includes external threads that thread to mating internal threads of the collar 107 to fix the cap 170 and the collar 107 together. The cap 170 includes a shoulder 171 that maintains the locking plate 169 in place in the transverse direction.

As shown in FIGS. 24-27, the tension assembly 163 includes a spring 173, a cable 174 (e.g., wire, rope, etc.), a plug 175, a bearing 176, and a split ring 177. The spring 173 is configured to provide a force that induces the threshold friction to retain the control arm 105 in its rotational position relative to the collar 107. As shown, the spring 173 is a coil spring (e.g., helical spring) that is placed into compression upon assembly into a bore of the control arm 105. However, other types of springs may be employed with the tension assembly 163. The control arm 105 includes a first internal stop 155 that retains a first end 173*a* of the spring 173, and a second internal stop 156 that retains the plug 175, which in turn retains a second end 173*b* of the spring 173 within the bore of the control arm 105 through the cable 174. As shown, the spring 173 is in compression to provide the force for inducing the friction. However, the spring may be configured to provide the force in tension.

Figure 28:
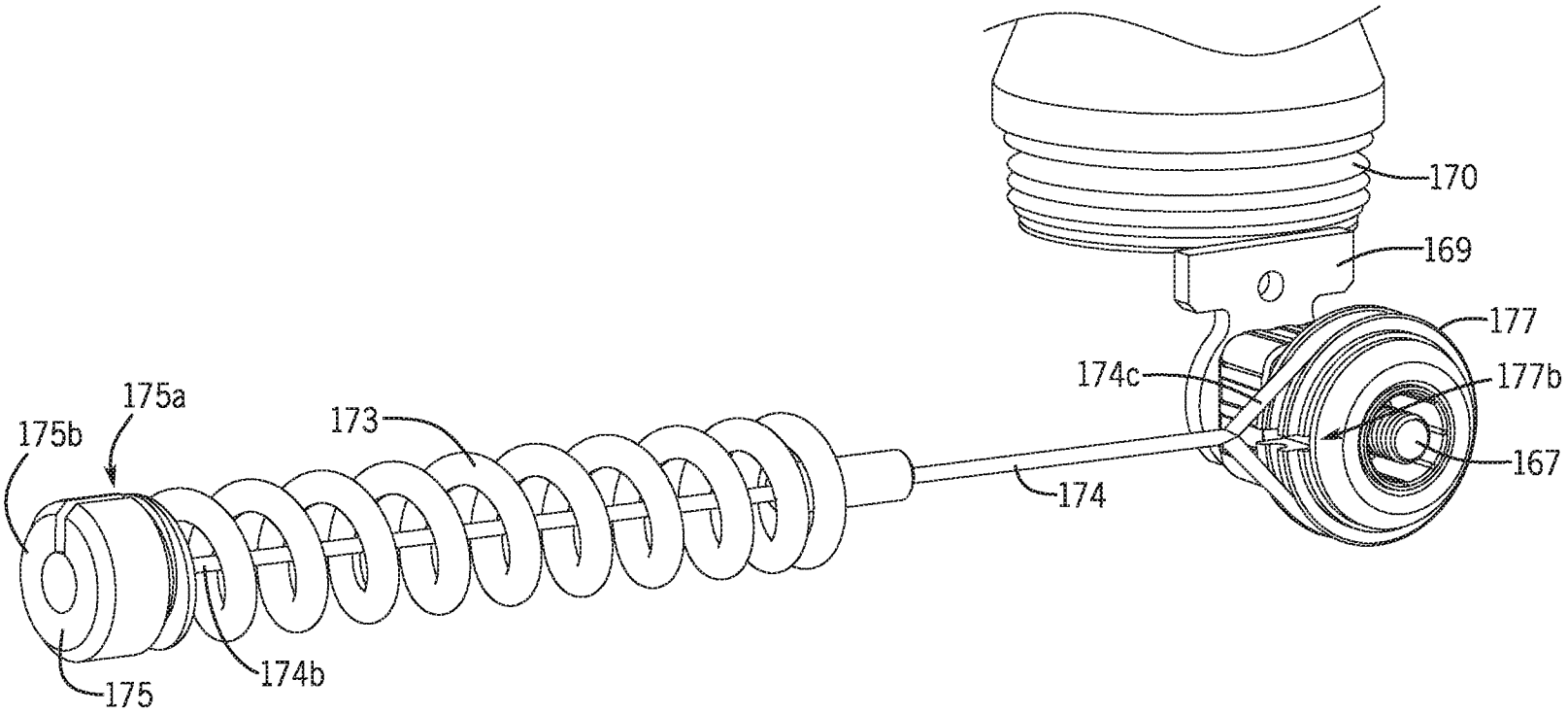
FIG. 28 is another perspective view of the retainer and pivot assembly shown in FIG. 24.

The cable 174 has an elongated portion 174*a* that extends through the coils of the spring 173, as well as a first end 174*b* and a second end 174*c*. The first end 174*b* of the cable 174 is fixedly coupled to the plug 175. For example, a fitting on the first end 174*b* may be configured to engage a slot 175*a* in a body 175*b* of the plug 175 to retain the cable 174 and fitting to the plug 175. The second end 174*c* of the cable 174 is coupled to the bushing assembly 161. As shown in FIGS. 26-28, the second end 174*c* is wound (e.g., wrapped, etc.) around the bushing assembly 161 forming a loop. The second end 174*c* may be coupled to another portion of the cable 174 to maintain the loop (e.g., size, shape, etc.). The bearing 176 is disposed on the second shoulder 165*b* of the shaft 165 and, as shown, has an L-shaped cross-sectional shape. The split ring 177 is disposed on the bearing 176 and, as shown, includes a recess 177*a* (e.g., a channel, a groove, etc.) in an outer surface for receiving and retaining the second end 174*c* of the cable 174, which is wound around the split ring 177 within the recess 177*a*. As shown best in FIG. 28, the split ring 177 is an annular shaped element with a radially extending notch 177*b* that extends through the thickness of the split ring 177. The notch 177*b* advantageously allows the cable 174 to compress (e.g., squeeze together) the split ring 177 to create the threshold friction and allow the split ring 177 to rotate with the cable 174 relative to the shaft 165. The bearing 176 may include a similar notch to that of the notch 177*b* in the split ring 177 (e.g., which may provide the same advantages).

During rotation of the control arm 105 relative to the collar 107, the wound end of the cable 174 is rotated around shaft 165 with the control arm 105. The force from the spring 173 is transferred through the cable 174 to the split ring 177 and/or the bearing 176 to induce the threshold friction between the bushing assembly 161 (e.g., the shaft 165) and the tension assembly 163 (e.g., the split ring 177 and/or bearing 176). This threshold friction maintains the rotational position of the control arm 105 relative to the collar 107, so that the control arm 150 remains in the position without a user having to hold the arm in the selected position.

Other embodiments can be used to retain the position of the control arm 105 relative to the collar 107. For example, one or more spring washers or washers in combination with a spring could be employed to compress together in a direction along the longitudinal axis 165*f* to generate the threshold friction. It was found that this design had a reduced durability and less control over the friction force compared with the embodiment described above. Also, for example, two gears could be employed to generate the threshold friction. Each gear could include a flat annular element with teeth around a circumference (e.g., a crown gear), such that the teeth of the first gear engage the teeth of the second gear to hold the position until a threshold torque rotates one gear relative to the other gear. It was found that this design produced undesirable noise (e.g., clicking) during rotation and provides limited adjustment set by the number of teeth rather than infinite adjustment according to the above described embodiment.

The control arms disclosed in this application (e.g., control arms 105, 205, 305, 405, 505) or elements of the controls arms may include or be made with a spring biased material, shape memory material, or other suitable material that may provide additional utility (e.g., movement).

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the faucets as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element (e.g., base, collar, hose, control arm, sprayhead, joint, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A faucet, comprising:

a base;

a collar extending from the base, wherein the collar is rotatable relative to the base about a longitudinal axis;

a control arm comprising a first end, which is pivotally coupled to the collar about a pivot axis, and a second end opposite the first end;

a retainer that maintains a rotational position of the control arm about the pivot axis, wherein the retainer comprises:

a bushing assembly rotatably connecting the control arm to the collar; and a cable disposed within the control arm and having a first end, which is retained in the control arm, and a second end, which is directly coupled in a rotatable manner to the bushing assembly;

a sprayhead configured to emit water and operatively coupled to the control arm at the second end of the control arm; and a flexible hose separate from the control arm and configured to fluidly connect the sprayhead and the base.

2. The faucet of claim 1, further comprising a spheroidal joint operatively coupling the sprayhead to the second end of the control arm, wherein the spheroidal joint comprises a ball, which is coupled to one of the sprayhead and the second end of the control arm, and a socket, which is coupled to the other of the sprayhead and the second end of the control arm.

3. The faucet of claim 2, wherein at least one of the ball and the socket is magnetic and attracts the other of the ball and the socket through a magnetic force, and wherein the sprayhead is detachably coupled to the control arm through the spheroidal joint.

4. The faucet of claim 1, wherein the retainer further comprises a helical spring, having a first end, which is retained by a stop of the control arm, and a second end, wherein the cable extends through the coils of the helical spring from the first end of the helical spring to the second end of the helical spring.

5. The faucet of claim 4, wherein the first end of the control arm includes a bore extending along a length of the first end, and the helical spring is disposed within the bore.

6. The faucet of claim 5, further comprising a plug disposed within the bore, coupled to the first end of the cable, and retaining the second end of the helical spring.

7. The faucet of claim 1, wherein the control arm is rotatable relative to the collar about the pivot axis, which extends radially relative to the longitudinal axis.

8. The faucet of claim 1, wherein the collar is rotatably disposed on an upper end of the base.

9. The faucet of claim 1, wherein the retainer further comprises a helical spring disposed within the control arm and acting on the cable so as to place the cable in tension.

10. The faucet of claim 1, wherein the second end of the cable is rotatably wound around the bushing assembly.

11. The faucet of claim 1, wherein the retainer further comprises a split ring disposed between the second end of the cable and the bushing assembly.

12. A faucet, comprising:

a base;

a collar extending from the base, wherein the collar is rotatable relative to the base about a longitudinal axis;

a control arm comprising a first end, which is pivotally coupled to the collar about a pivot axis, and a second end opposite the first end, wherein the first end includes a bore extending along a length of the first end;

a retainer that maintains a rotational position of the control arm about the pivot axis, wherein the retainer comprises:

a bushing assembly rotatably connecting the control arm to the collar;

a helical spring disposed within the bore of the control arm and having a first end, which is retained by a stop of the control arm, and a second end;

a cable extending through the coils of the helical spring between a first end and a second end of the cable, wherein the second end of the cable is rotatably coupled to the bushing assembly; and a plug disposed within the bore, coupled to the first end of the cable, and retaining a second end of the helical spring;

a sprayhead configured to emit water and operatively coupled to the second end of the control arm; and a flexible hose separate from the control arm and configured to fluidly connect the sprayhead and the base, wherein the bushing assembly comprises a shaft having an inner shoulder, which extends into the collar, and an outer shoulder, which extends into the control arm.

13. The faucet of claim 12, further comprising a bearing disposed around at least a portion of the inner shoulder, wherein the bearing has a shape that provides anti-rotation between the bearing and the collar.

14. The faucet of claim 13, further comprising a fastener that couples the control arm to the bushing assembly, wherein the fastener extends through a bore in the shaft of the bushing assembly.

15. A faucet, comprising:

a base;

a collar extending from the base, wherein the collar is rotatable relative to the base about a longitudinal axis;

a control arm comprising a first end, which is pivotally coupled to the collar about a pivot axis, and a second end opposite the first end;

a retainer that maintains a rotational position of the control arm about the pivot axis, wherein the retainer comprises:

a bushing assembly rotatably connecting the control arm to the collar;

a helical spring disposed within the control arm and having a first end, which is retained by a stop of the control arm, and a second end; and a cable extending through the coils of the helical spring between a first end and a second end of the cable, wherein the second end of the cable is rotatably coupled to the bushing assembly, and wherein the second end of the cable is rotatably wound around the bushing assembly;

a sprayhead configured to emit water and operatively coupled to the second end of the control arm; and a flexible hose separate from the control arm and configured to fluidly connect the sprayhead and the base.

* * * * *